US005588470A

United States Patent [19]

Shiraki et al.

[11] Patent Number: 5,588,470

[45] Date of Patent: Dec. 31, 1996

[54] WEFT INSERTING DEVICE FOR AN AIR JET LOOM HAVING REED PIECES WITH RECESSED WEFT GUIDE OPENINGS

[75] Inventors: Masao Shiraki, Kariya; Fujio Suzuki, Toyota; Kazunori Yoshida, Nagoya, all of Japan

[73] Assignees: Kabushiki Kaisha Toyoda Jidoshokki Seisakusho, Kariya; Kabushiki Kaisha Toyota Chuo Kenkyusho, Nagakute-cho, both of Japan

[21] Appl. No.: 498,786

[22] Filed: Jul. 5, 1995

[30] Foreign Application Priority Data

Jul. 5, 1994 [JP] Japan ..... 6-153939
May 16, 1995 [JP] Japan ..... 7-117411

[51] Int. Cl.[6] ..... D03D 47/30
[52] U.S. Cl. ..... 139/435.5
[58] Field of Search ..... 139/435.5, 192

[56] References Cited

U.S. PATENT DOCUMENTS 4,989,646 2/1991 Nitta et al. ..... 139/435.5 X
5,323,814 6/1994 Shiraki et al. ..... 139/435.5 X

FOREIGN PATENT DOCUMENTS 0533948 3/1993 European Pat. Off. .
2348297 11/1977 France .
3000240 7/1981 Germany .
55-93844 7/1980 Japan .
57-95344 6/1982 Japan .
59-26688 6/1984 Japan .
0075644 4/1985 Japan ..... 139/435.5
253935 2/1990 Japan .
338378 4/1991 Japan .
3199451 8/1991 Japan .
2117802 10/1983 United Kingdom .

*Primary Examiner*—Andy Falik
*Attorney, Agent, or Firm*—Brooks Haidt Haffner & Delahunty

[57] ABSTRACT

A weft inserting device using a profiled reed for an air jet loom is equipped with a plurality of reed pieces each having a C-shaped guide notch. The line of guide notches forms a weft passage where weft injected from a main nozzle flies. Each guide notch has a upper wall parallel to the floor surface on which the device is placed, a deep wall perpendicular to this surface, a lower wall which gradually becomes wider toward an opening, an upper connecting portion which connects the upper wall to the deep wall, and a lower connecting portion which connects the deep wall to the lower wall. The radius of curvature of the upper connecting portion is set equal to or smaller than 1 mm, and the radius of curvature of the lower connecting portion is set greater than the radius of curvature of the upper connecting portion.

15 Claims, 16 Drawing Sheets

WEFT INSERTING DEVICE FOR AN AIR JET LOOM HAVING REED PIECES WITH RECESSED WEFT GUIDE OPENINGS

BACKGROUND OF THE INVENTION

1. Field of the Invention

The present invention relates generally to a weft inserting device for guiding weft flying into, for example, an air jet loom, and, more particularly, to a weft inserting device which uses a profiled reed designed to improve the stability of the flying weft.

2. Description of the Related Art

There are two types of conventional weft inserting devices for guiding the flying of weft inserted by an air jet. The first type uses an air guide and the other uses a profiled reed.

Some known weft inserting devices using an air guide are disclosed in Japanese Unexamined Patent Publication Nos. Sho-55-93844 and Sho-57-95344 and Japanese Patent Publication No. Sho-59-26688. In general, those weft inserting devices using an air guide have air guides for guiding the flying of weft, a separate reed, and a supplemental nozzle attached with each air guide to assist in guiding the flying of the weft. Each air guide has a circular or rectangular guide hole or C-shaped guide notch. A plurality of guides are arranged on the front side of the reed to provide guide holes or guide notches along the lengthwise direction of the reed. As the guides are arranged in the lengthwise direction of the reed (in the weft inserting direction), the line of the guide holes or guide notches forms a weft passage where weft flies.

The reed beats the weft after inserting the weft into the weft passage. The guide hole or guide notch of each air guide has a great design freedom with respect to its shape, and the shape and the air injecting position of each supplemental nozzle, which assists the flying of weft, can also be designed freely. It is therefore possible to easily set the ideal shape of the guide hole or guide notch and the ideal arrangement of the supplemental nozzles. A weft inserting device using such air guides has a higher air use efficiency than a weft inserting device that uses a profiled reed, and is thus advantageous for stable weft flying.

In the weft inserting device using air guides, however, every time weft is inserted, the air guides should enter the warp openings, weaving through the warp. The reed beats the weft after inserting the weft. At the time of beating the reed, the air guides should come under the warp. The fast entering or retraction of the air guides in or from the warp openings may damage the warp. Further, the reciprocation of each air guide between the position inside the associated warp opening and the position under the warp involves a larger swinging distance of the sley as compared with the case of the weft inserting device that uses a profiled reed. Therefore, the weft inserting device using air guides has difficulty in functioning at a high velocity.

Some known weft inserting devices using a profiled reed are disclosed in Japanese Unexamined Patent Publication No. Hei-2-53935 and Japanese Unexamined Utility Model Publication No. Hei-3-38378. In general, a weft inserting device using a profiled reed has the general construction shown in FIG. 1 but employs a profiled reed 120 provided with guide notches 140 for guiding the flying of weft Y (see FIG. 1) as shown in FIGS. 27, 28, 29, 30 and 31. When reeds shown in FIGS. 27 to 31 are aligned the line of the guide notches 140 forms a weft passage T, similar to the passage shown in FIG. 1. Each guide notch 140 has a horizontal upper wall 141, a vertical deep wall 142, a lower wall 143 extending toward an opening 146, a curved upper connecting portion 144, which connects the upper wall 141 to the deep wall 142, and a curved lower connecting portion 145, which connects the deep wall 142 to the lower wall 143. Supplemental nozzles 160 (FIG. 27, 28 and 29) for assisting the flying of the weft Y are attached at predetermined intervals along the weft passage T, and have injection holes 161 at their distal ends.

In a weft inserting device using the thus constituted profiled reeds, at the time weft is inserted, only the supplemental nozzles 160 enter the associated warp openings, weaving through the warp, while at the time of beating the reed, only the supplemental nozzles 160 come under the warp from the warp openings. As the supplemental nozzles 160 are thin, the warp is hardly damaged even if the supplemental nozzles 160 move into or out of the warp openings at a high velocity. Further, only the supplemental nozzles 160 smaller than the air guides should move between inside the associated warp openings and under the warp, thus requiring a smaller swinging distance of the sley as compared with the case of the weft inserting device that uses air guides. Therefore, the weft inserting device using a profiled reed is advantageous in increasing the operating speed of the air jet loom. The conventional weft inserting device using the profiled reed 120 shown in FIGS. 27 to 31 however has several shortcomings as will be discussed below.

The radius of curvature of each of the upper connecting portions 144 and the lower connecting portion 145 in FIGS. 27 to 31 is set as large as about 2 mm in consideration of, for example, suppressing the disturbance of the air stream in the weft passage T and facilitating punch-out production using a pressing machine. In the weft inserting device using such a profiled reed, therefore, the flying position of the weft Y flying through the weft passage T varies depending on the position on the wall of the guide notch 140 where the air stream S jetted from the supplemental nozzle 160 hits. Some examples of the change in the flying position of the weft Y will be described with reference to FIGS. 27 to 29, each showing a reed piece 130 from the upstream side in the weft inserting direction.

To begin with, with reference to FIG. 27, a description will be given of the relation between a change in the position of the maximum stream velocity and the flying position Y20 of the weft Y in the case where an air stream S20 hits on the upper wall 141. The "position of the maximum stream velocity" (hereinafter referred to as "maximum stream velocity position") means the position or area at which the air stream flowing through the weft passage T reaches the maximum velocity, and generally coincides with the position or area where an air stream S injected from the supplemental nozzle 160 is present. The air stream S20 injected from the supplemental nozzle 160 hits against the upper wall 141, then proceeds toward the deep wall 142, and changes its course downward along the upper connecting portion 144 to flow toward the opening 146 from the deep wall 142. Accordingly, the maximum stream velocity position also shifts, so that the weft Y is influenced by the downward deflected stream at the upper connecting portion 144 and flies near the lower connecting portion 145 as indicated by the flying position Y20.

Next, with reference to FIG. 28, a description will be given of the relation between the transition of the maximum stream velocity position (the location of an air stream S21) and the flying position Y21 of the weft Y in the case where the air stream S21 strikes on the deep wall 142. The air stream S21 injected from the supplemental nozzle 160 strikes the deep wall 142, then changes its course upward along the upper connecting portion 144, and flows toward the opening 146 from the deep wall 142 along the upper wall 141. Accordingly, the maximum stream velocity position also shifts, so that the weft Y is influenced by the upward deflected stream at the upper connecting portion 144 and flies near the upper wall 141 as indicated by the flying position Y21.

With reference to FIG. 29, a description will now be given of the relation between the transition of the maximum stream velocity position (the location of an air stream S22) and the flying position Y22 of the weft Y in the case where the air stream S22 strikes the upper connecting portion 144. The air stream S22 injected from the supplemental nozzle 160 strikes the upper connecting portion 144, and then flows toward the opening 146 along substantially the same path as the path of the forward movement. Accordingly, the maximum stream velocity position also shifts, so that the weft Y flies near the upper connecting portion 144 as indicated by the flying position Y22.

As apparent from the above description of three cases, the flying velocity of the weft Y and the flying stability of the weft Y are associated with the flying position of the weft Y. In other words, the flying velocity of the weft Y and the flying stability of the weft Y are related to the air stream velocity distribution in the weft passage T.

Therefore, the relation among the flying velocity of the weft Y, the flying stability of the weft Y and the air stream velocity distribution in the weft passage T will be discussed below with reference to FIGS. 30 and 31. FIG. 30 shows the air stream velocity distribution at a position of 60 mm downstream from the supplemental nozzles 160 in the weft passage T when the supplemental nozzles 160 are arranged at intervals of 60 mm, and FIG. 31 shows the air stream velocity distribution at a position of 80 mm downstream from the supplemental nozzles 160 in the weft passage T when the supplemental nozzles 160 are arranged at intervals of 80 mm. The broken lines represent the uniform velocity distribution lines whose intervals indicate the units of 10 meters per second (m/s). The position indicated by Vm is the maximum stream velocity position.

As has been discussed referring to FIG. 27, the air stream S20 directed toward the opening 146 is weak in the vicinity of the flying position Y20, so that the weft Y flying near the flying position Y20 does not fly off the weft passage T, stabilizing the flying state of the weft Y. Since the air stream velocity near the flying position Y20 is lower than he air stream velocity at the maximum stream velocity position Vm, however, the flying velocity of the weft Y flying at the flying position Y20 is slower. It is not therefore possible to increase the flying velocity of the weft Y.

Because the flying position Y21 is near the maximum stream velocity position Vm, the air stream velocity at the position Y21 is close to the maximum velocity so that the flying velocity of the weft Y flying at the flying position Y21 is high. As has been discussed referring to FIG. 28, however, the air stream S21 directed toward the opening 146 is strong in the vicinity of the flying position Y21, so that the weft Y flying near the flying position Y21 is likely to fly off the weft passage T, making the flying state of the weft Y unstable. Therefore, the flying stability of the weft Y cannot be improved.

Further, the flying position Y22 is also near the maximum stream velocity position Vm and the air stream velocity at the position Y22 is thus close to the maximum velocity. That is, the weft Y flies at a high velocity at the flying position Y22. As has been discussed referring to FIG. 29, the air stream S22 directed toward the opening 146 is weak in the vicinity of the flying position Y22, so that the weft Y flying near the flying position Y22 does not fly off the weft passage T. The flying state of the weft Y therefore is stable.

To accomplish the fast and stable flying of the weft Y, therefore, the flying position of the weft Y should be kept at the flying position Y22. For this purpose, it is important to direct the air stream S, injected from the supplemental nozzle 160, toward the upper connecting portion 144 and to allow the weft Y to fly near the upper connecting portion 144. It is, however, inevitable that the installation positions of the supplemental nozzles 160 relative to the weft passage T, the installation angles of the supplemental nozzles 160, and the injecting directions and injection pressures at the injection holes 161 will vary. Actually, the position of the air stream S hitting on the wall of the guide notch 140 changes.

In the weft inserting devices using a profiled reed as described in the aforementioned Japanese Unexamined Patent Publication No. Hei-2-53935 and Japanese Unexamined Utility Model Publication NO. Hei-3-38378, the angle between the upper wall 141 and deep wall 142 of the guide notch 140 is set to a right angle or an acute angle to make the top portion of the weft passage T deeper, thereby suppressing the flow of the air stream S, injected from the supplemental nozzle 160, toward the opening 146. Even when the top portion of the weft passage T is made deeper, however, the upper connecting portion 144 which connects the upper wall 141 to the deep wall 142 dose not permit the weft Y to fly stably in some cases.

According to the conventional weft inserting devices, as described above, increasing the flying velocity of the weft and suppressing the problem of the weft flying off the weft passage cannot be satisfied at the same time.

SUMMARY OF THE INVENTION

Accordingly, it is a primary objective of the present invention to provide a weft inserting device for an air jet loom that allows weft to fly stably and at a high velocity in a weft passage formed by arranging a plurality of reed pieces each having a guide notch.

To achieve the foregoing and other objects and in accordance with a first aspect of the present invention, there is a provided for a weft inserting device of air jet type loom. The weft inserting device of an air jet type loom has a sley. A reed is mounted on said sley, said reed including a plurality of reed pieces arranged in an inserting direction of a weft, each of said plurality of reed pieces has a recess into which the weft is inserted and a plurality of said recesses form a weft passage. A main nozzle generates an air jet to insert the weft into the recesses. A supplemental nozzle generates an air jet to assist the insertion of the weft into the recesses, said recesses being open towards the air from the air jet generated by the supplemental nozzle. Said recess is substantially defined by an upper wall, a lower wall and a deep wall, and said lower wall is connected to said deep wall by way of a lower connecting portion having a first radius of curvature and said upper wall is connected to said deep wall by way of an upper connecting portion having a second radius of curvature, said second radius of curvature being smaller than said first radius of curvature.

According to a second aspect of the present invention, the second radius of curvature is no greater than 1 mm. Consequently, the air stream after striking the upper wall flows to the upper connecting portion and the weft stably flies near the upper connecting portion.

According to a third aspect of the present invention, said lower wall has a length ratio with respect to the length of the upper wall ranging from 25% to 55% at least in the neighborhood of said supplemental nozzle. Accordingly, the air stream leaking downward from the weft passage is reduced, and the air stream velocity in the vicinity of the upper connecting portion is generally increased.

According to a fourth aspect of the present invention, a weft inserting device further has air leakage means for increasing the amount of air leaked from between said plurality of reed pieces at said upper connecting portion. Consequently, the air stream near the upper connecting portion is likely to be pulled toward the upper connecting portion. It is therefore possible to keep the flying position of the weft stable in the weft passage in the vicinity of the upper connecting portion and keep the flying velocity of the weft high.

BRIEF DESCRIPTION OF THE DRAWINGS

The features of the present invention that are believed to be novel are set forth with particularity in the appended claims. The invention, together with objects and advantages thereof, may best be understood by reference to the following description of the presently preferred embodiments together with the accompanying drawings in which:

DETAILED DESCRIPTION OF THE PREFERRED EMBODIMENTS

Figures 1, 1A:
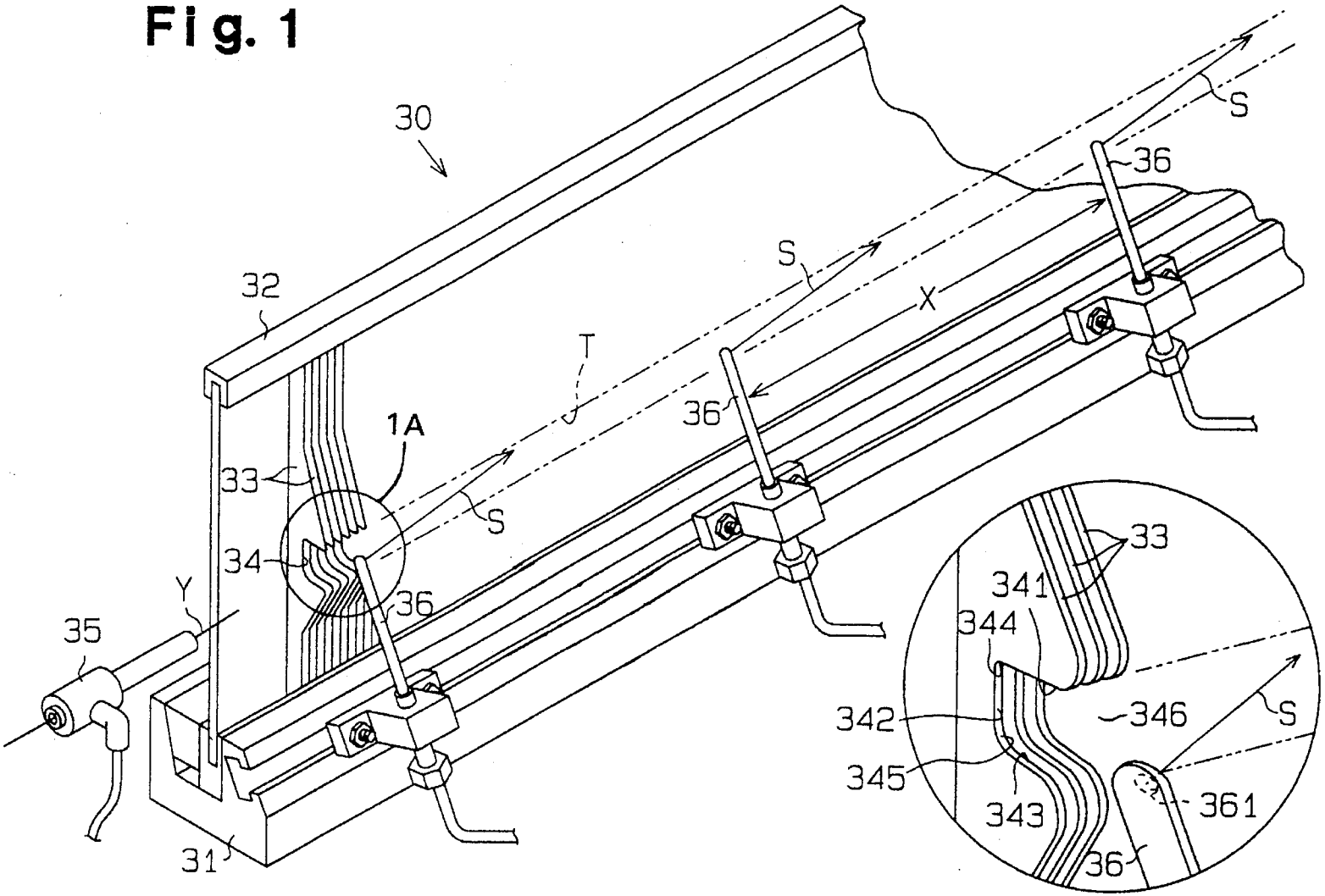
FIG. 1 is a view showing the general structure of a weft inserting device using a profiled reed for an air jet loom according to a first embodiment including a region 1A.
FIG. 1A is an enlarged view of region 1A in FIG. 1.

A first embodiment of the present invention as adapted for a weft inserting device using a profiled reed for an air jet loom will now be described referring to FIGS. 1 through 12. To begin with, the general structure of a weft inserting device 30 will be described with reference to FIG. 1 and FIG. 1A.

A profiled reed 32 is fixed upright on a sley 31. The profiled reed 32 has multiple reed pieces 33 arranged in the weft inserting direction. Each reed piece 33 has a C-shaped guide notche or recess 34, and the row of the reed pieces 33 including the guide notch 34 forms a weft passage T where a weft Y, injected from a main nozzle 35 for weft insertion, flies. The weft passage T and the profiled reed 32 are designed integrally with each other.

Figure 2:
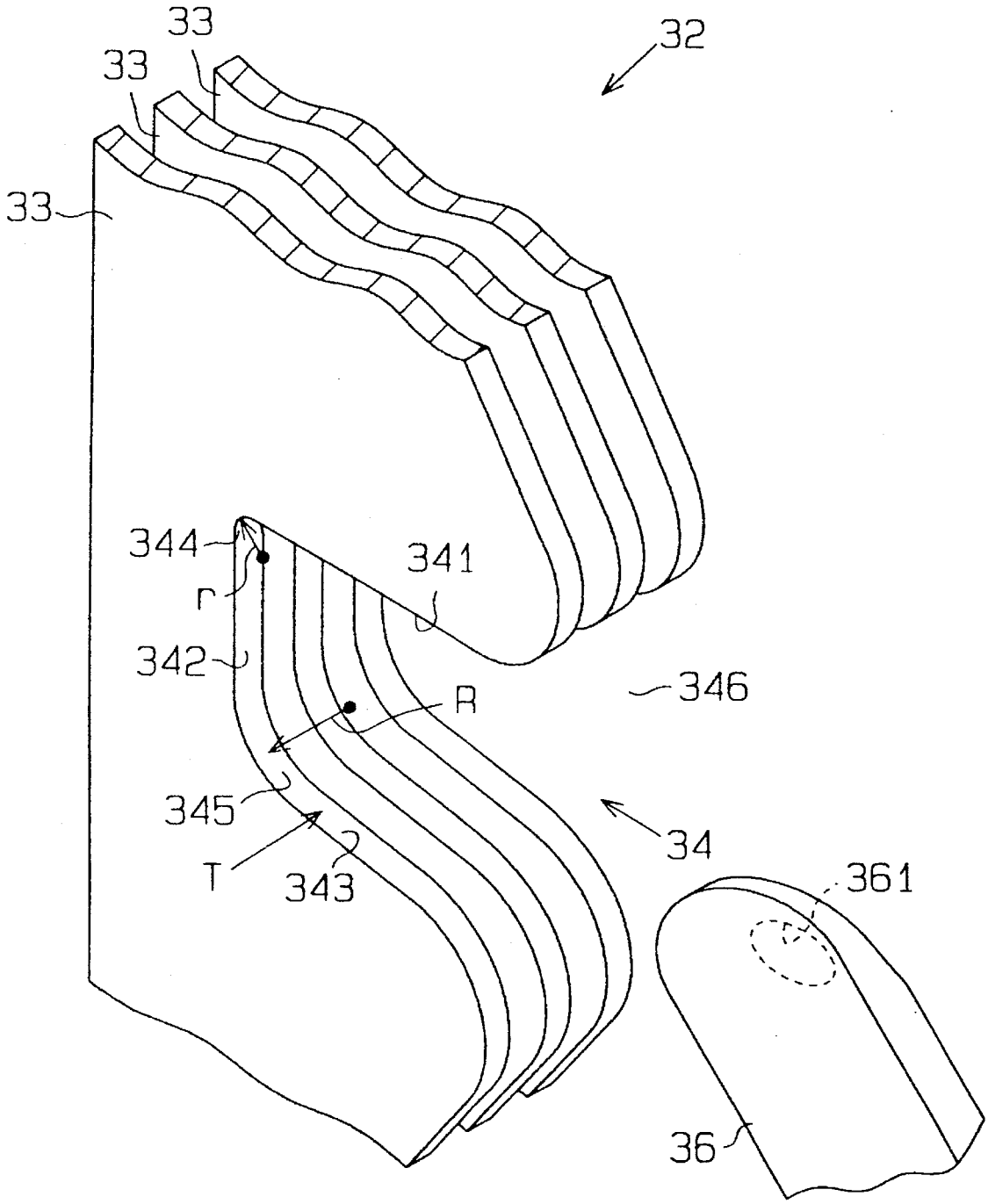
FIG. 2 is an enlarged perspective view of the essential portions of the weft inserting device according to the first embodiment.
Figure 3:
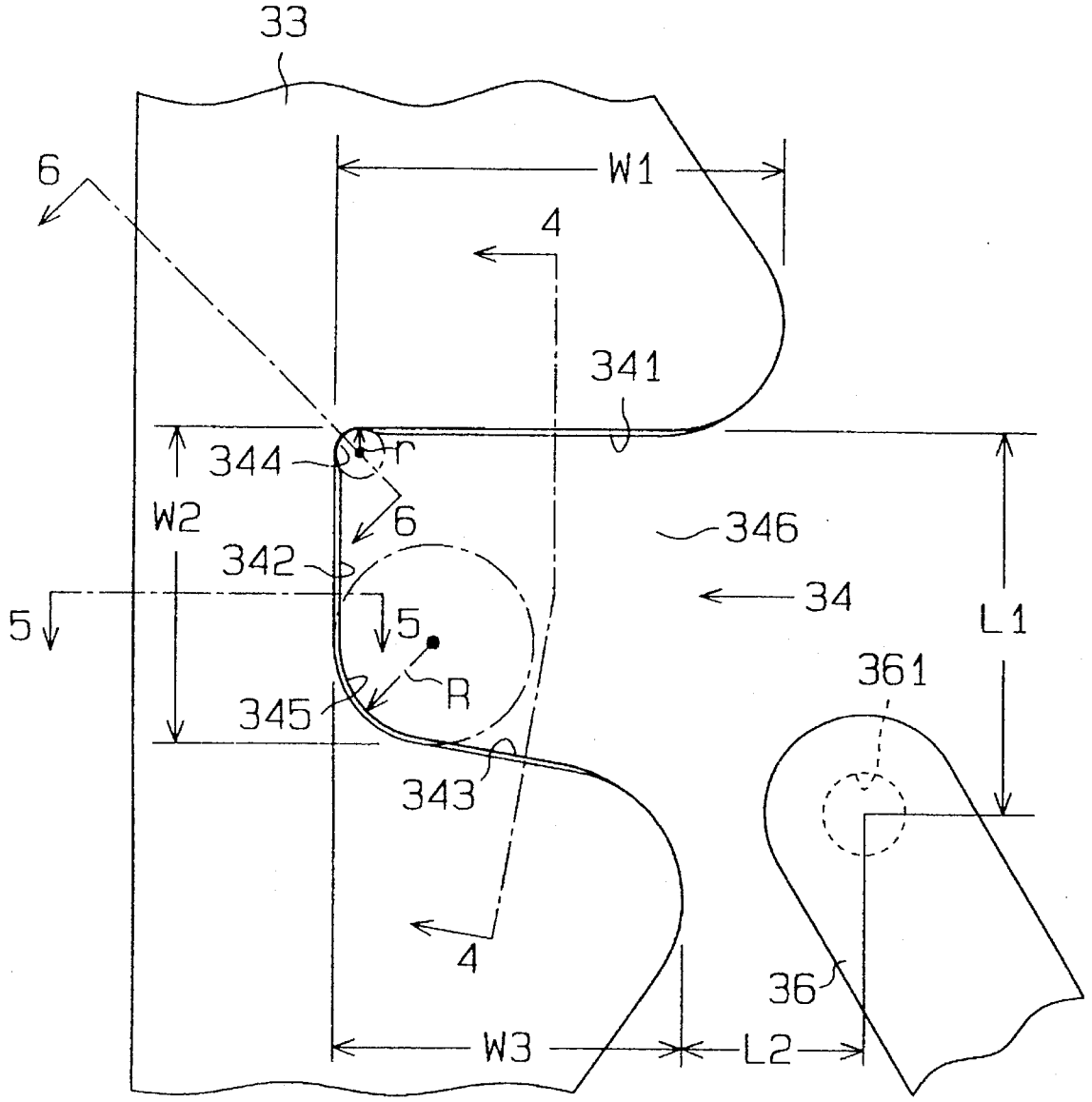
FIG. 3 is an enlarged side view of the essential portions of the weft inserting device according to the first embodiment.

As shown in FIGS. 1A–2 each guide notch 34 has a upper wall 341 parallel to the floor surface on which the weft inserting device 30 is placed, a vertical deep wall 342, a lower wall 343 extending toward an opening 346, an arcuate upper connecting portion 344, which connects the upper wall 341 to the deep wall 342, and an arcuate lower connecting portion 345, which connects the deep wall 342 to the lower wall 343. As shown in FIG. 3, the length W1 of the upper wall 341 extending from the deep wall 342 is set to 9 mm, the vertical length W2 of the deep wall 342 is set to 5.5 mm, and the length W3 of the lower wall 343 extending from the deep wall 342 is set to 7 mm. Therefore, the size W3 of the lower wall 343 is about 78% of the size W1 of the upper wall 341. The angle between the upper wall 341 and the deep wall 342 is a right angle.

Figure 6:
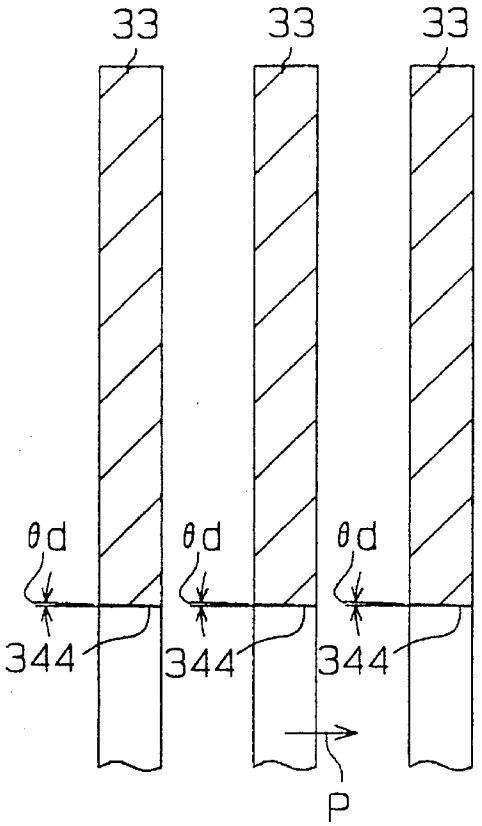
FIG. 6 is an enlarged cross-sectional view along the line 6—6 in FIG. 3.
Figure 5:
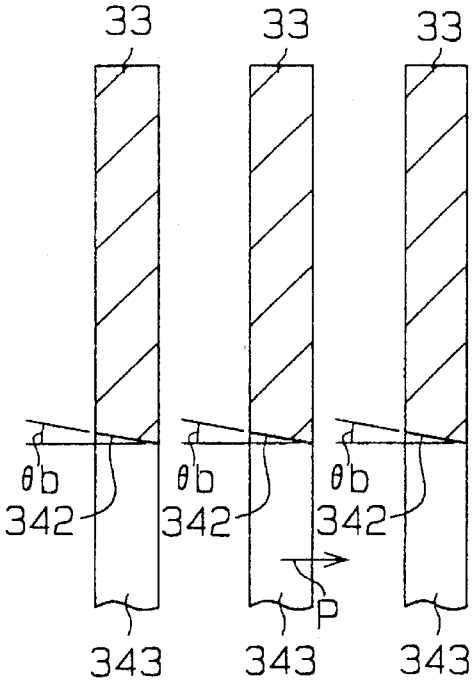
FIG. 5 is an enlarged cross-sectional view along the line 5—5 in FIG. 3.
Figure 4:
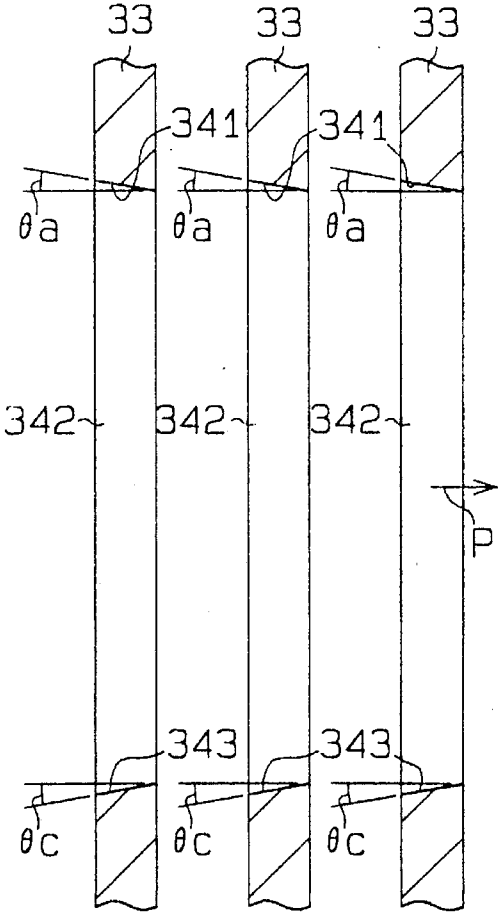
FIG. 4 is an enlarged cross-sectional view along the line 4—4 in FIG. 3.

The radius of curvature r of the upper connecting portion 344 is set to 0.5 mm, and the radius of curvature R of the lower connecting portion 345 is set to 2 mm. As shown in FIGS. 4 to 6, the upper wall 341, the deep wall 342, the lower wall 343, the upper connecting portion 344 and the lower connecting portion 345 are inclined in such a way that the opening area becomes narrower toward the weft inserting direction indicated by an arrow P (Fig.4). The inclined angle θa of the upper wall 341, the inclined angle θb of the deep wall 342, the inclined angle θc of the lower wall 343 and the inclined angle θe of the lower connecting portion 345 are all 10 degrees, while the inclined angle θd of the upper connecting portion is 2 degrees.

A plurality of supplemental nozzles 36 for weft insertion are attached to the front face of the sley 31 along the weft passage T at predetermined equal intervals. Each supplemental nozzle 36 has an injection hole 361 at the distal end, which is close to the weft passage T. The injection hole 361 is aligned in such a manner that an air stream S ejected from the injection hole 361 reaches the upper connecting portion 344 from below the opening 346 in the weft passage T, as indicated by an arrow S in FIG. 1.

If the supplemental nozzle 36 is simply set close to the weft passage T, the bending of warp (not shown) between the supplemental nozzle 36, which enters and leaves the opening of the warp, and the associated reed piece 33 becomes greater, damaging the warp and thus reducing the quality of the woven fabric. In this respect, the vertical distance L1 from the upper wall 341 to the injection hole 361 of the supplemental nozzle 36, and the horizontal distance L2 from the distal end of the lower wall 343 on the side of the opening 346 to the injection hole 361, are set in such a way that the supplemental nozzle 36 does not adversely influence the quality of the woven fabric.

The supplemental nozzle 36 has a parts allowance, and an assembling error may occur at the time the supplemental nozzle 36 is installed. Actually, therefore, it is not unlikely that the air stream S injected from the injection hole 361 will strike the upper wall 341 or the deep wall 342. The air stream S sometimes strikes the lower wall 343.

Figure 7:
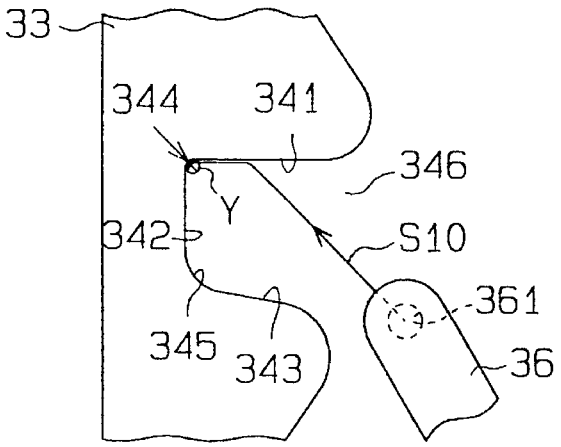
FIG. 7 is an explanatory diagram illustrating the transition of the air stream from a supplemental nozzle for weft insertion when this air stream strikes the upper wall.
Figure 27:
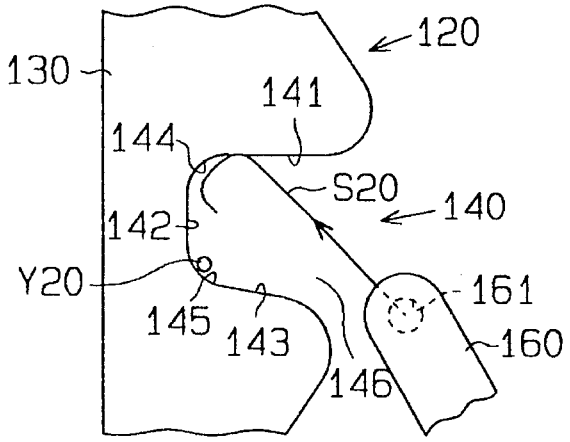
Fig. 27 PRIOR ART
FIG. 27 is an explanatory diagram of a conventional weft inserting device illustrating the transition of the air stream from a supplemental nozzle for weft insertion when this air stream strikes the upper wall.

When an air stream S10 strikes the upper wall 341, as shown in FIG. 7, for example, this air stream S10 flows toward the deep wall 342 along the upper wall 341. According to the conventional weft inserting device, as shown in FIG. 27, in which the upper connecting portion 144 has a radius of curvature of about 2 mm, the air stream S20 after striking the upper wall 141 is deflected toward the lower wall 143 along the deep wall 142 from the upper connecting portion 144. According to the weft inserting device 30 of this embodiment, however, the upper connecting portion 344 having a radius of curvature r of 0.5 mm restricts the deflection of the air stream S10 after striking the upper wall 341, significantly weakening the flow of the air stream S10 toward the opening 346. Therefore, the air stream S10 after striking the upper wall 341 flows to the upper connecting portion 344 and the weft Y stably flies near the upper connecting portion 344.

Figure 8:
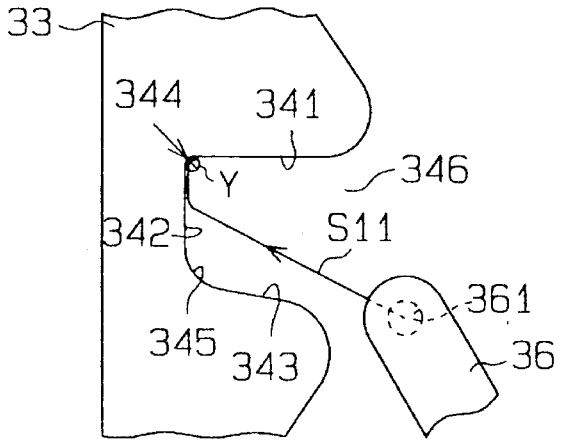
FIG. 8 is an explanatory diagram illustrating the transition of the air stream from the supplemental nozzle when this air stream strikes the deep wall.
Figure 28:
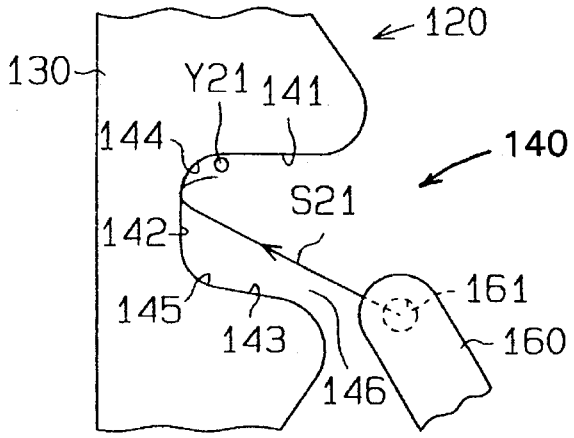
Fig. 28 PRIOR ART
FIG. 28 is an explanatory diagram of a conventional weft inserting device illustrating the transition of an air stream from a supplemental nozzle for weft insertion when this air stream hits on the deep wall.

When an air stream S11 strikes the deep wall 342 as shown in FIG. 8, this air stream S11 flows toward the upper wall 341 along the deep wall 342. FIG. 28 shows a conventional weft inserting device whose upper connecting portion 144 has a radius of curvature of about 2 mm, the air stream S21 after striking the deep wall 142 is deflected toward the opening 146 along the upper wall 141 from the upper connecting portion 144. In the weft inserting device 30 of this embodiment, however, the upper connecting portion 344 whose radius of curvature r is 0.5 mm restricts the deflection of the air stream S11 after hitting the deep wall 342, significantly weakening the flow of the air stream S11 toward the opening 346. Therefore, the air stream S11 after striking the deep wall 342 flows to the upper connecting portion 344 and the weft Y flies stably near the upper connecting portion 344.

Figure 9:
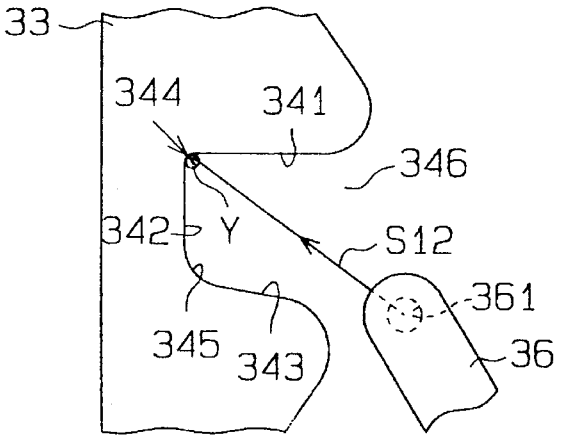
FIG. 9 is an explanatory diagram illustrating the transition of the air stream from the supplemental nozzle when this air stream strikes the upper connecting portion.
Figure 29:
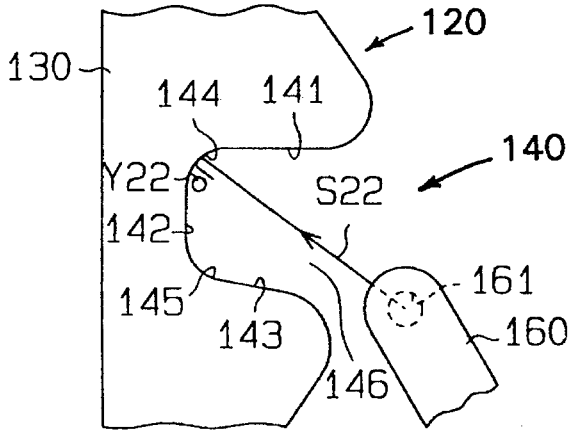
Fig. 29 PRIOR ART
FIG. 29 is an explanatory diagram of a conventional weft inserting device illustrating the transition of an air stream from a supplemental nozzle for weft insertion when this air stream strikes the upper connecting portion.

When an air stream S12 strikes the upper connecting portion 344 as shown in FIG. 9, this air stream S12 stays at the upper connecting portion 344 and flows a downstream of the weft inserting direction. FIG. 29 shows conventional weft inserting device whose upper connecting portion 144 has a radius of curvature of about 2 mm, the air stream S22, after striking the upper connecting portion 144, is deflected toward the opening 146 from the upper connecting portion 144. The weft inserting device 30 of this embodiment is provided with the upper connecting portion 344 whose radius of curvature r is 0.5 mm to restrict the deflection of the air stream S12 after striking the upper connecting portion 344, significantly weakening the flow of the air stream S12 toward the opening 346. Therefore, the air stream S12 after striking the upper connecting portion 344 stays at the upper connecting portion 344 and the weft Y flies stably near the upper connecting portion 344.

When the air stream S strikes the lower wall 343 though not illustrated, this air stream S flows toward the deep wall 342 along the lower wall 343. Since the radius of curvature R of the lower connecting portion 345 is 2 mm, unlike the upper connecting portion 344 which has a small radius of curvature r of 0.5 mm, the air stream S, after striking the lower wall 343, does not stay at the lower connecting portion 345. Therefore, the air stream S, after striking the lower wall 343, flows to the upper connecting portion 344 via the lower connecting portion 345 and the deep wall 342, and the weft Y flies stably near the upper connecting portion 344.

Part of the air stream flowing in the weft inserting direction P leaks out of the weft passage T from between the reed pieces 33, which are arranged adjacent to one another. The greater the leakage ratio is, the lower the velocity of the air stream flowing in the weft inserting direction P becomes, thus lowering the flying velocity of the weft Y. The individual walls 341, 342 and 343 of each guide notch 34 in this embodiment are inclined to be narrower in the weft inserting direction, thus suppressing the leakage of the air stream from between the reed pieces 33. This prevents the flying velocity of the weft Y from decreasing due to the leakage of the air stream and keeps the flying velocity of the weft Y high.

The inclined angle and the ratio of the air leakage have a close relationship such that, as the inclined angle decreases, the ratio of the air leakage increases. The inclined angle θd of the upper connecting portion 344 in this embodiment is set considerably smaller than the other inclined angles θa, θb, θc and θe. As the air stream is pulled toward the locations where the air leaks or toward the upper connecting portion 344, therefore, the weft Y can fly around the upper connecting portion 344 more stably.

Figure 10:
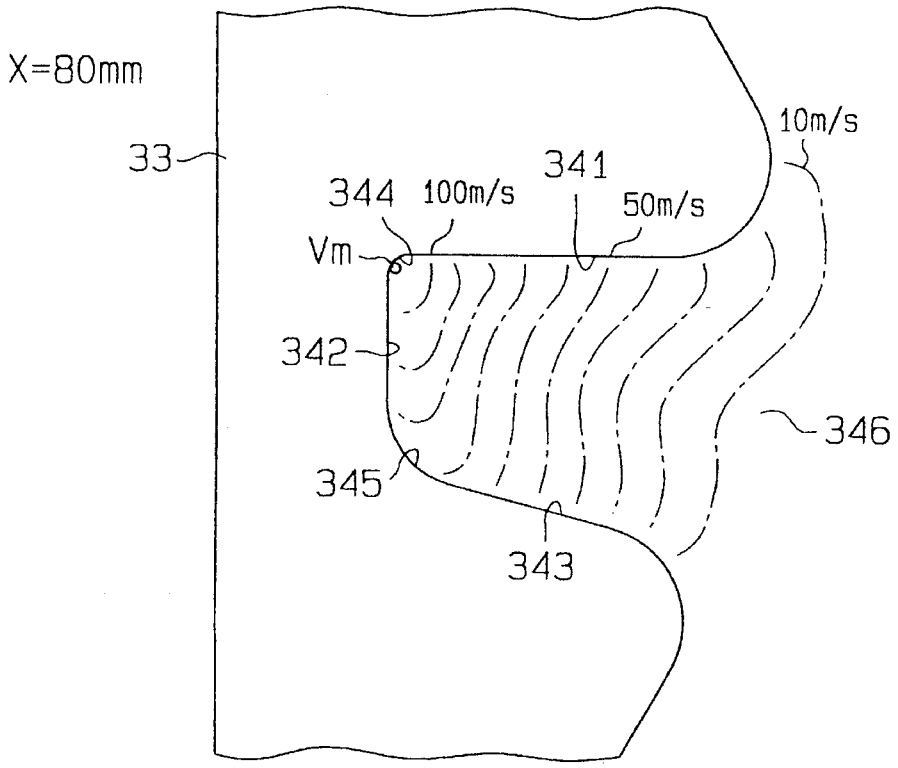
FIG. 10 is an enlarged side view of the essential portions for explaining the air stream velocity distribution at a position of 80 mm downstream from the supplemental nozzles in a weft passage when the supplemental nozzles are arranged at intervals of 80 mm.
Figure 11:
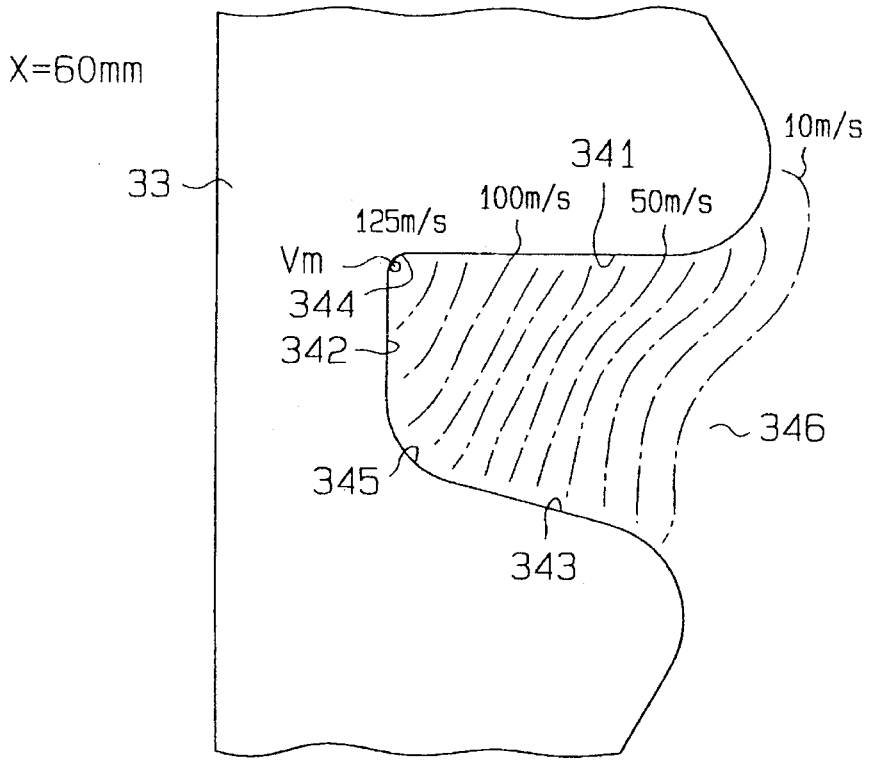
FIG. 11 is an enlarged side view of the essential portions for explaining the air stream velocity distribution at a position of 60 mm downstream from the supplemental nozzles in a weft passage when the supplemental nozzles are arranged at intervals of 60 mm.

Next, the relation among the flying velocity of the weft Y, the flying stability of the weft Y and the air stream velocity distribution in the weft passage T will be discussed with reference to FIGS. 10 and 11. FIG. 10 shows the air stream velocity distribution at a position of 80 mm downstream from the supplemental nozzles in the weft passage T when the supplemental nozzles 36 are arranged at intervals X of 80 mm, and FIG. 11 shows the air stream velocity distribution at a position of 60 mm downstream from the supplemental nozzles in the weft passage T when the supplemental nozzles 36 are arranged at intervals X of 60 mm. The broken lines represent uniform velocity distribution lines whose intervals indicate units of 10 m/s. The position indicated by Vm is the maximum stream velocity position.

Figure 30:
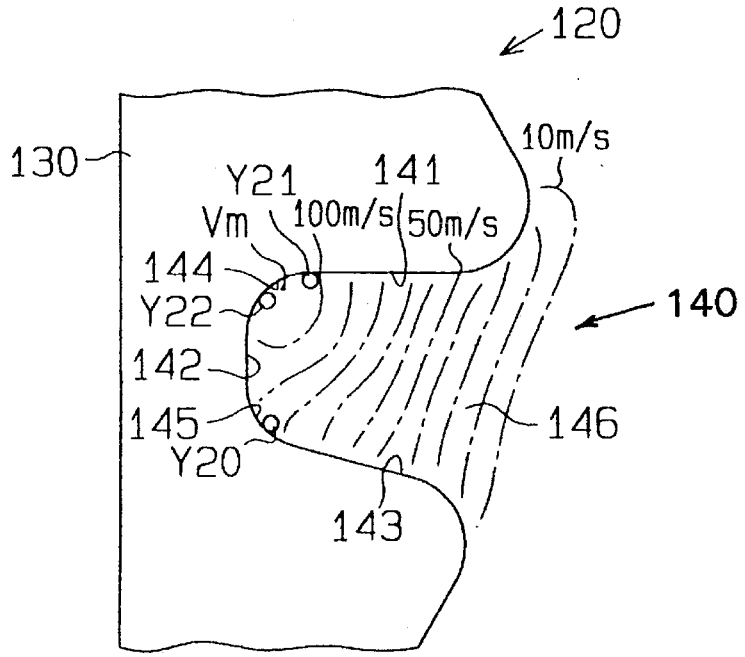
Fig. 30 PRIOR ART
FIG. 30 is an enlarged side view of the essential portions of a conventional weft inserting device for explaining the air stream velocity distribution at a position of 60 mm downstream from a supplemental nozzle in a weft passage when supplemental nozzles for weft insertion are arranged at intervals of 60 mm.
Figure 31:
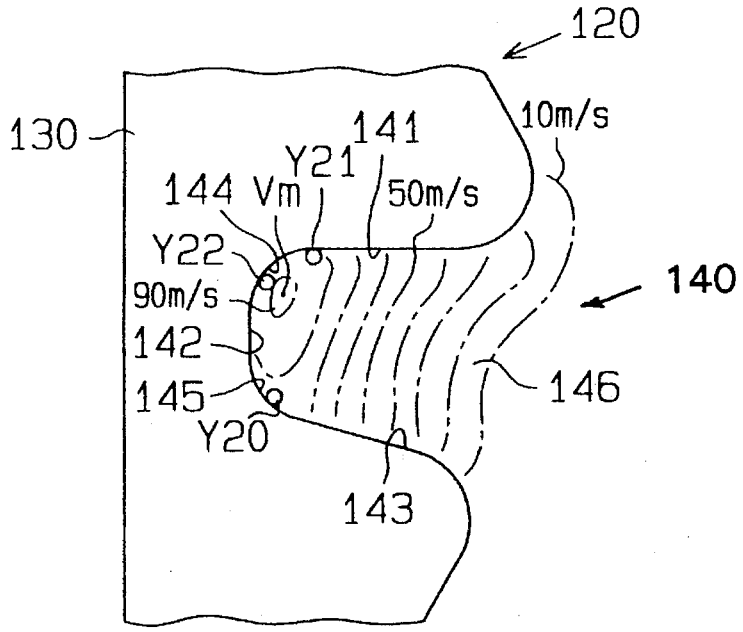
Fig. 31 PRIOR ART
FIG. 31 is an enlarged side view of the essential portions of a conventional weft inserting device for explaining the air stream velocity distribution at a position of 80 mm downstream from a supplemental nozzle in a weft passage when the supplemental nozzles for weft insertion are arranged at intervals of 80 mm.

It is apparent that the air stream velocity in the weft passage T in this embodiment is generally higher than the air stream velocity in the weft passage T in the prior art shown in FIGS. 30 and 31. The increased air stream velocity is achieved by the inclination of the individual walls 341, 342 and 343 of the guide notch 34.

As shown in FIGS. 10 and 11, the flying velocity of the weft Y and the flying stability of the weft Y have a close relationship to the flying position of the weft Y. In other words, the flying velocity of the weft Y and the flying stability of the weft Y have a close relationship to the air stream velocity distribution. It is most desirable that the weft Y should fly near the upper connecting portion 344. The weft inserting device according to this embodiment has such a structure that when the air stream S injected from the supplemental nozzle 36 strikes any wall of the guide notch 34, the flying position of the weft Y is restricted to the upper connecting portion 344. Therefore, the weft Y flies close to the upper connecting portion 344 which is the maximum stream velocity position Vm, and the weft Y flies fast and stable.

Figure 12:
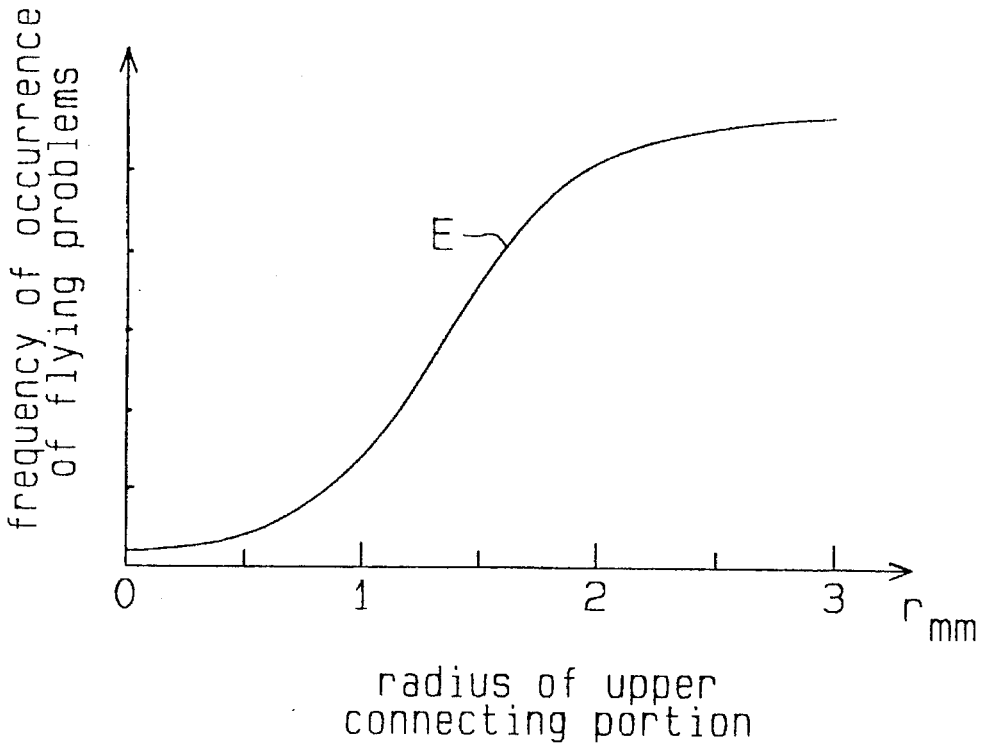
FIG. 12 is a graph for explaining the relation between the radius of curvature of the upper connecting portion and the frequency of weft flying problems.
Figure 13:
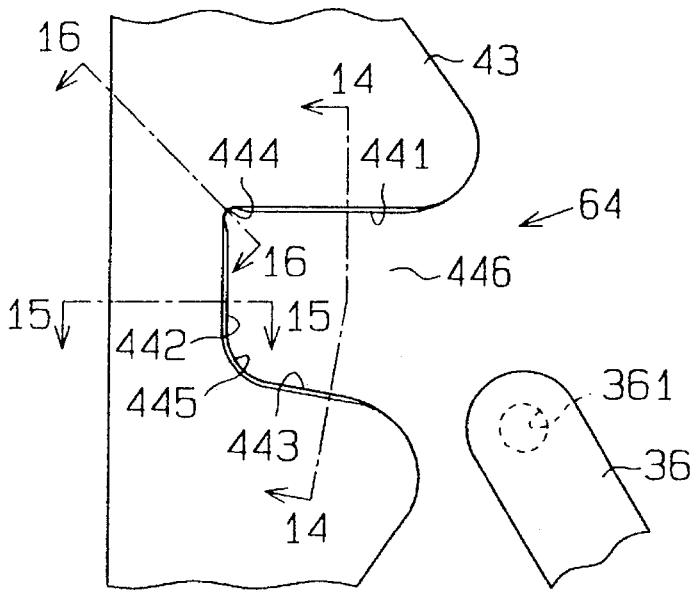
FIG. 13 is an enlarged side view of the essential portions of a weft inserting device using a profiled reed for an air jet loom according to a second embodiment.
Figure 14:
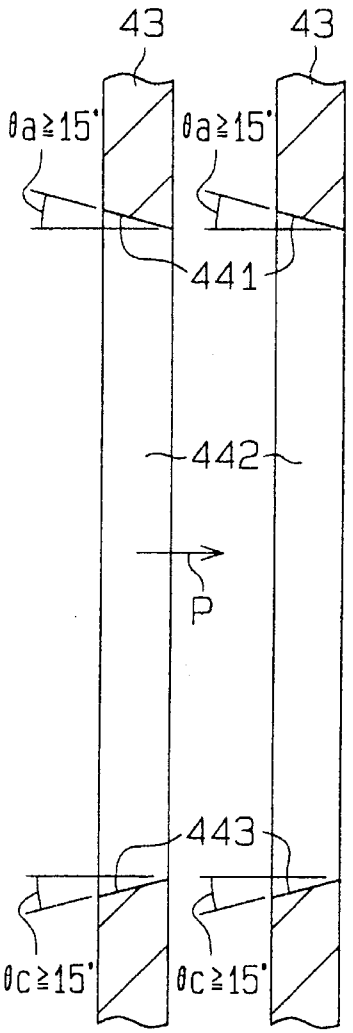
FIG. 14 is an enlarged cross-sectional view along the line 14—14 in FIG. 13.
Figure 15:
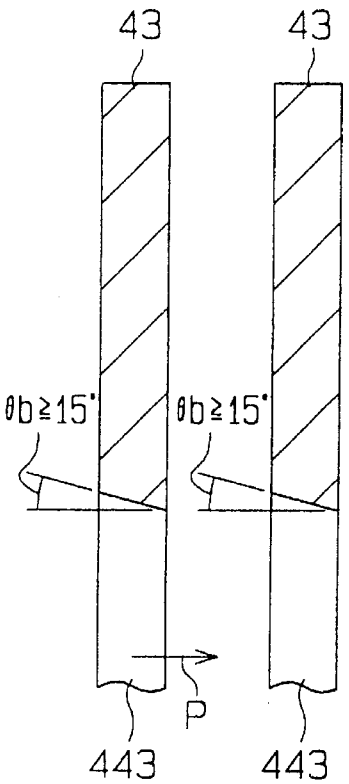
FIG. 15 is an enlarged cross-sectional view along the line 15—15 in FIG. 13.

A curve E in the graph in FIG. 12 represents data obtained from an experiment indicating the relation between the radius of curvature r of the upper connecting portion 344 and the frequency of the flying problems of the weft Y. This experiment was conducted with standard cotton Ne 40 used as the weft Y under conditions of a loom velocity of 800 rpm and a constant air flow rate. This graph shows that to reduce the frequency of the flying problems to 20%, which occur when a conventional weft inserting device whose upper connecting portion 144 has a radius of curvature of about 2 mm is used, the radius of curvature of the upper connecting portion 344 should be set equal to or smaller than 1 mm.

Conventionally, an attempt was made to increase the radius of curvature of the upper connecting portion 144 in order to suppress the air disturbance in the weft passage T. Therefore, many conventional Weft inserting devices have an upper connecting portion 144 having a radius of curvature of 2 mm or greater, and a change in the radius of curvature in such an area does not influence the flying problems. Based on an idea opposite to the conventional concept, the present inventor has ensured the flying stability of the weft Y by suppressing the deflection of the air stream in the weft passage T to converge the air stream to the upper connecting portion 344.

Although the inclined angles θa, θb, θc and θe are constant in the above-described embodiment, those inclined angles need not be constant as long as they are greater than the inclined angle θd.

A second embodiment of this invention will now be described with reference to FIGS. 13 through 16. The weft inserting device of this embodiment as well as those of other embodiments which will be discussed later have the same basic constitution as the structure of the weft inserting device 30 of the first embodiment. Only the differences in structure from the first embodiment will be discussed hereunder with the same reference numerals or symbols given to the identical components whose descriptions will be omitted.

Figure 16A:
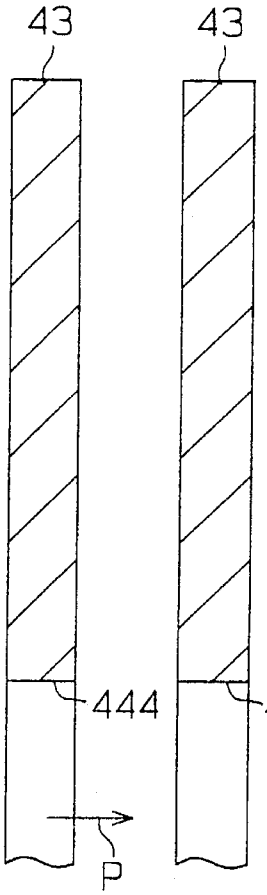
FIGS. 16A and B are enlarged cross-sectional views along the line 16—16 in FIG. 13.
Figure 16B:
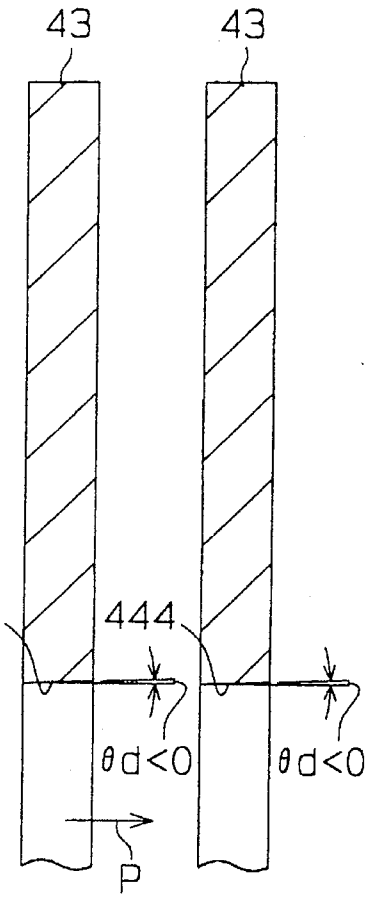

Each reed piece 43 of a profiled reed 42 according to the second embodiment has a upper wall 441, a deep wall 442, a lower wall 443 and a lower connecting portion 445, all of which define a guide notch 44. Each reed piece 43 also has an upper connecting portion 444 extending parallel to the weft inserting direction as shown in FIG. 16A or having an inclined angle widening in the weft inserting direction as shown in FIG. 16B. The upper wall 441, deep wall 442, lower wall 443 and lower connecting portion 445 have such inclined angles that the opening area of the guide notch 44 becomes smaller in the weft inserting direction indicated by an arrow P. The inclined angle θa of the upper wall 441, the inclined angle θb of the deep wall 442, the inclined angle θc of the lower wall 443 and the inclined angle θe of the lower connecting portion 445 are all set equal to or larger than 15 degrees. This setting of the individual inclined angles θa, θb, θc and θe further increases the velocity of the air stream in the weft passage T.

While the flying velocity of the weft Y increases in this case, it is difficult to keep the weft Y stable near the upper connecting portion 444. Therefore, the air in the vicinity of the upper connecting portion 444 is positively caused to leak from between the individual reed pieces 43 by setting the inclined angle θd of the upper connecting portion 444 to zero degrees as shown in FIG. 16A or setting the inclined angle θd smaller than zero degrees as shown in FIG. 16B. Consequently, the air stream near the upper connecting portion 444 is likely to be pulled toward the upper connecting portion 444. It is therefore possible to keep the flying position of the weft Y stable in the weft passage T in the vicinity of the upper connecting portion 444 and keep the flying velocity of the weft Y high.

Although the upper wall 341, the lower wall 343 and the deep wall 342 in the first embodiment and the upper wall 441, the lower wall 443 and the deep wall 442 in the second embodiment are all inclined, one of those walls 341 or 441, 342 or 442 and 343 or 443 or only a part of the individual walls 341 or 441, 342 or 442 and 343 or 443 may be inclined.

Further, the ratio of the air leakage from the upper connecting portion 344 or 444 can be increased by setting the inclined angles of the individual walls 341 or 441, 342 or 442, and 343 or 443 smaller gradually or setting the weft passage T apart from the individual walls 341 or 441, 342 or 442, and 343 or 443. As a result, the air stream in the weft passage T converges to the upper connecting portion 344 or 444, allowing the flying position of the weft Y to be stably maintained. Furthermore, the ratio of the air leakage from the upper connecting portion 344 or 444 can also be increased by not inclining the upper walls 341 or 441, the lower wall 343 or 443 or the deep wall 342 or 442 but reducing the inclined angle of the upper connecting portion 344 or 444. As a result, the air stream in the weft passage T converges to the upper connecting portion 344 or 444, thus stabilizing the flying position of the weft Y.

Figure 17:
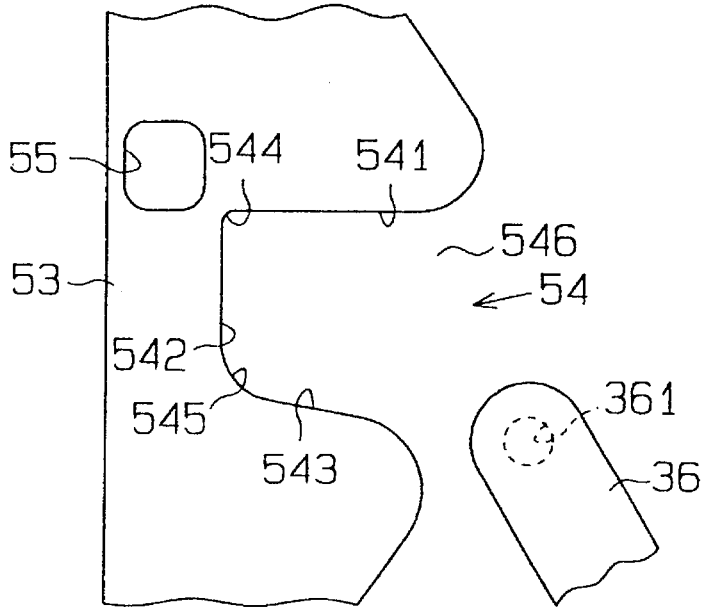
FIG. 17 is an enlarged side view of the essential portions of a weft inserting device using a profiled reed according to a third embodiment.

A third embodiment of this invention will now be described with reference to FIG. 17. Each reed piece 53 in this embodiment has a through hole 55 for air leakage formed obliquely above an upper connecting portion 544. The upper connecting portion 544 of the reed piece 53 has a radius of curvature r of 0.1 mm, while a lower connecting portion 545 has a radius of curvature R of 2.5 mm. This structure ensures easier air leakage from between the reed pieces 53 in the vicinity of the upper connecting portion 544 so that the air stream near the upper connecting portion 544 is more easily pulled toward the through hole 55. As a result, the flying position of the weft Y in the weft passage T is stabilized and maintained near the upper connecting portion 544. At this time, the individual walls 541, 542 and 543 of the guide notch 54 are inclined by about 10 degrees along the weft inserting direction of the weft Y to properly adjust the ratio of the air leakage. Consequently, the flying velocity of the weft Y is about the same as the flying velocity of the weft Y in the weft inserting device 30 of the first embodiment.

Figure 18:
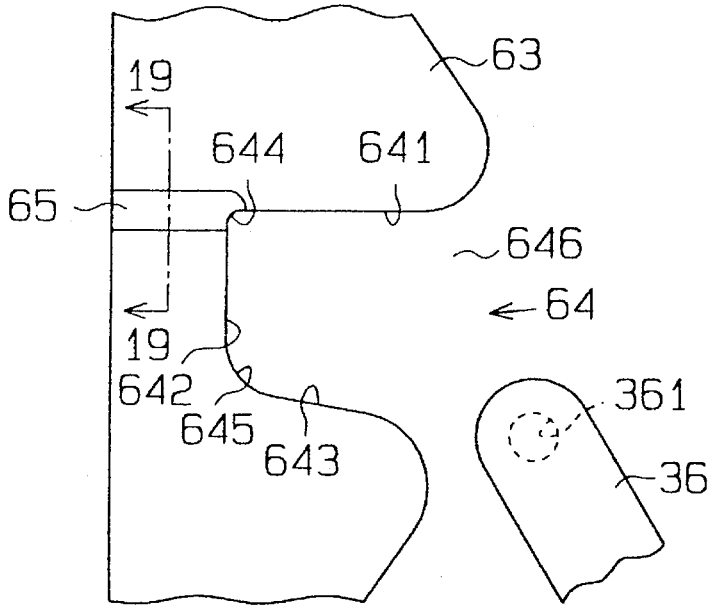
FIG. 18 is an enlarged side view of the essential portions of a weft inserting device using a profiled reed according to a fourth embodiment.
Figure 19:
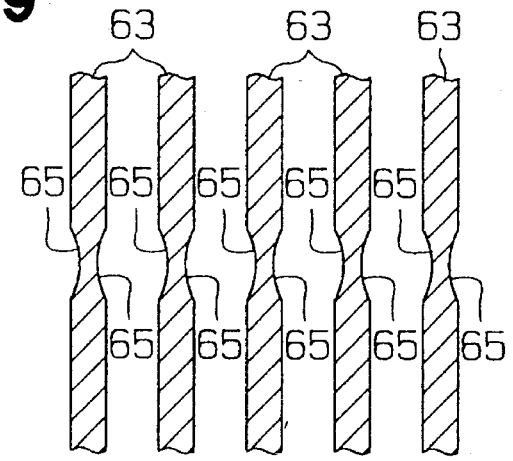
FIG. 19 is an enlarged cross-sectional view along the line 19—19 in FIG. 18.

A fourth embodiment of this invention will now be described with reference to FIGS. 18 and 19. Each reed piece 63 in this embodiment has air leakage grooves 65 formed on both sides, extending leftward in the diagrams from an upper connecting portion 644. The upper connecting portion 644 of the reed piece 63 has a radius of curvature r of 1 mm, while a lower connecting portion 645 has a radius of curvature R of 1.5 mm. Therefore, the intervals between the reed pieces 63 at the portions where the grooves 65 are located are greater than the intervals at the other portions. The air therefore becomes more likely to leak from between the reed pieces 63 in the vicinity of the upper connecting portion 644. Consequently, the air stream near the upper connecting portion 644 is more easily pulled toward the grooves 65 and the flying position of the weft Y in the weft passage T is stabilized and maintained in the proximity of the upper connecting portion 644. At this time, the individual walls 641, 642 and 643 of a guide notch 64 are inclined by about 10 degrees along the weft inserting direction of the weft Y to properly adjust the ratio of the air leakage. Consequently, the flying velocity of the weft Y is about the same as the flying velocity of the weft Y in the weft inserting device 30 of the first embodiment.

Figure 20:
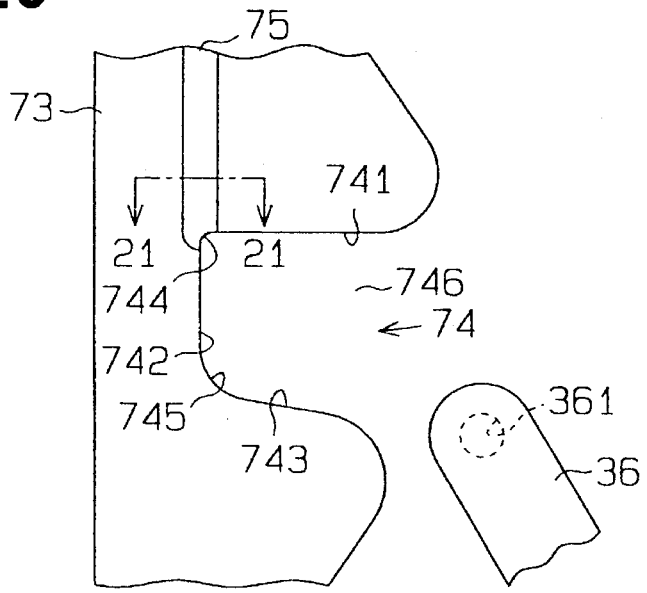
FIG. 20 is an enlarged side view of the essential portions of a weft inserting device using a profiled reed according to a fifth embodiment.
Figure 21:
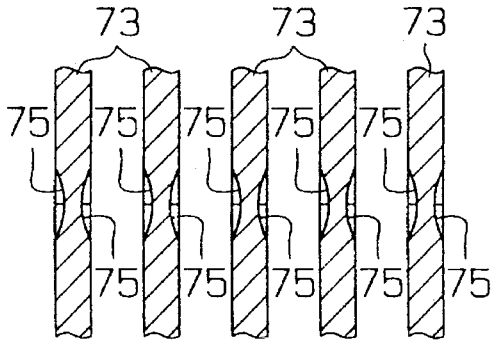
FIG. 21 is an enlarged cross-sectional view along the line 21—21 in FIG. 20.

A fifth embodiment of this invention will now be described with reference to FIGS. 20 and 21. Each reed piece 73 in this embodiment has air leakage grooves 75 formed on both sides, extending upward in the diagrams from an upper connecting portion 744. The upper connecting portion 744 of the reed piece 73 has a radius of curvature r of 1 mm, while a lower connecting portion 745 has a radius of curvature R of 1.5 mm. Therefore, the intervals between the reed pieces 73 at the portions where the grooves 75 are located are greater than the intervals at the other portions. The air therefore is more likely to leak from between the reed pieces 73 in the vicinity of the upper connecting portion 744. Consequently, the air stream near the upper connecting portion 744 is more easily pulled toward the grooves 75 and the flying position of the weft Y in the weft passage T is stabilized maintained in the proximity of the upper connecting portion 744.

The reed pieces 73 should have a strength to bear the impact of repeatedly performed beating. Particularly, the strength of the deep wall 742 on which the beating impact is concentrated must have sufficient strength. When each reed piece 73 has the grooves 75 on both sides as in the weft inserting device 70 of this embodiment, the strength of the reed piece 73 at the portions where the grooves 75 are located is lower. Since the grooves 75 in this embodiment deviate rightward of the deep wall 742 in the diagrams as compared with the grooves 65 in the fourth embodiment, however, the reduction in the strength caused by the presence of the grooves 75 is insignificant. It is therefore possible to form the grooves 75 deeper than the grooves in the fourth embodiment, causing the flying position of the weft Y in the weft passage T to be more stable in the vicinity of the upper connecting portion 744. The individual walls 741, 742 and 743 of a guide notch 74 are inclined by about 10 degrees along the weft inserting direction of the weft Y to properly adjust the ratio of the air leakage. Accordingly, the flying velocity of the weft Y is about the same as the flying velocity of the weft Y in the weft inserting device 30 of the first embodiment.

Figure 22:
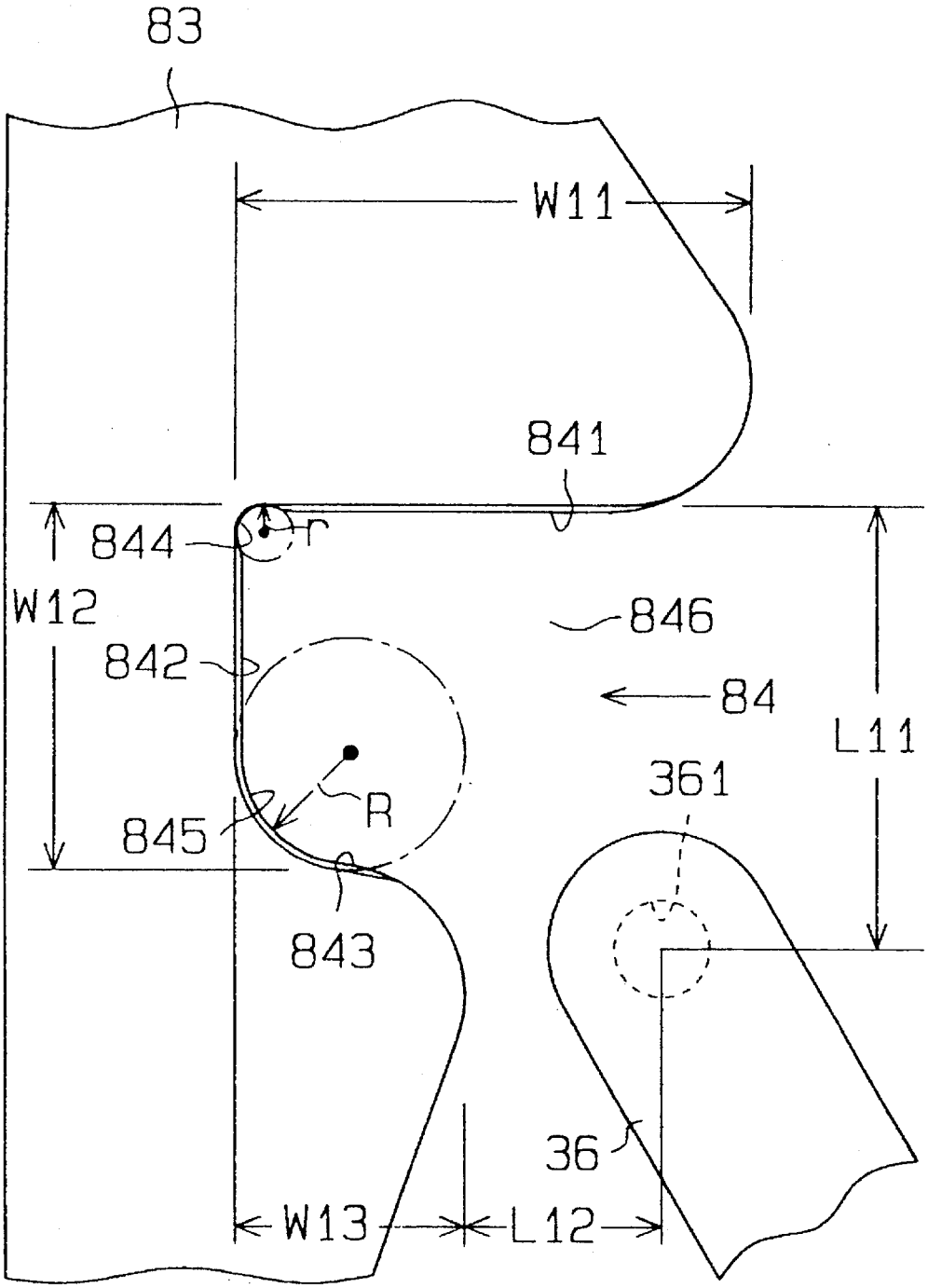
FIG. 22 is an enlarged side view of the essential portions of a weft inserting device using a profiled reed according to a sixth embodiment.

A sixth embodiment of this invention will now be described with reference to FIGS. 22 through 24. As shown in FIG. 22, a guide notch 84 of each reed piece 83 in this embodiment has a upper wall 841, a deep wall 842 and a lower wall 843. The upper wall 841 extending from the deep wall 842 has a size W11 of 9 mm, the deep wall 842 has a vertical size W2 of 5.5 mm and the lower wall 843 extending from the deep wall 842 has a size W13 of 4 mm. It is apparent that the distance from the deep wall 842 to the injection hole 361 is shorter by 3 mm than the distance for the reed piece 33 in the first embodiment. The injection hole 361 of the supplemental nozzle 36 is aligned in such a way as to direct the air stream S, injected from the supplemental nozzle 36, toward the upper connecting portion 844.

Figure 23:
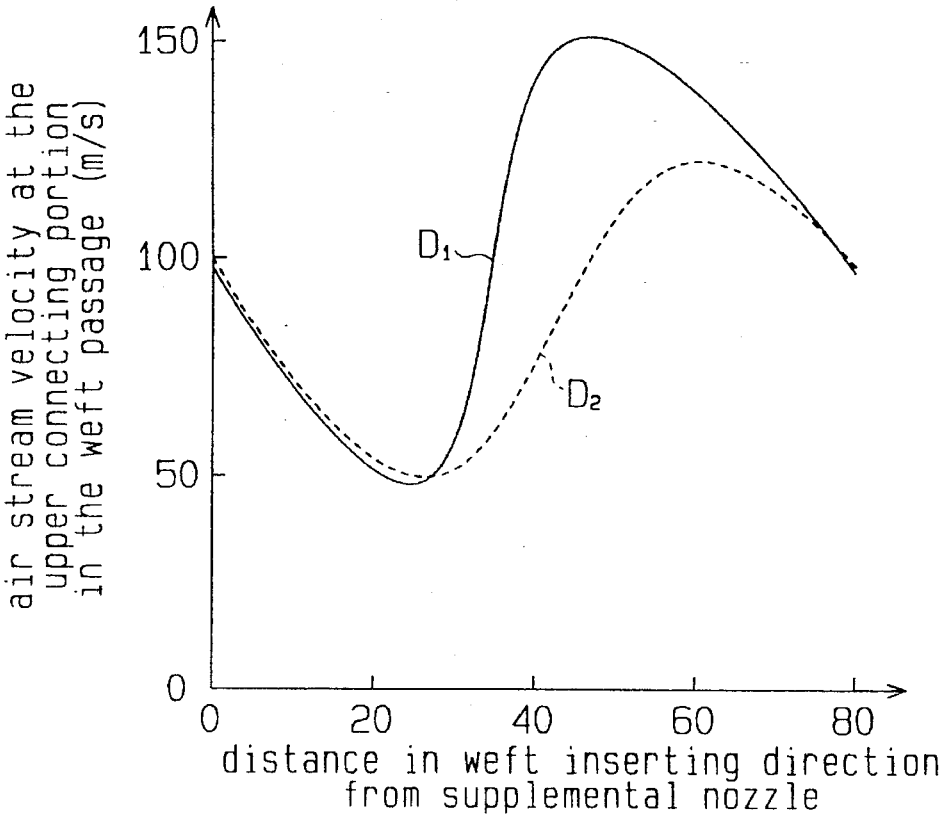
FIG. 23 is a diagram showing the air stream velocity distribution in the weft inserting direction near the upper connecting portions in the weft passage of the weft inserting device according to the sixth embodiment.

With reference to FIG. 23, a description will be given of the relation between the air stream velocity at the upper connecting portion 844 in the weft passage T and the distance in the weft inserting direction from the supplemental nozzle 36. The "distance in the weft inserting direction" means the horizontal distance toward the downstream side from the supplemental nozzle 36 in the weft inserting direction. The vertical scale indicates the air stream velocity at the upper connecting portion 844 in the weft passage T, and the horizontal scale indicates the distance in the weft inserting direction from the supplemental nozzle 36. A curve D1 represents the air stream velocity at the upper connecting portion 844 in the case where the profiled reed 82 of this embodiment is used, and a curve D2 represents the air stream velocity at the upper connecting portion 344 in the case where the profiled reed 32 of the first embodiment is used. The radius of curvature r of the upper connecting portion 844 in this embodiment, like the radius of curvature r of the upper connecting portion 344 in the first embodiment, is set smaller than the radius of curvature R of a lower connecting portion 845, so that the weft Y flies stably near the upper connecting portion 844. The profiled reed 82 of this embodiment is designed in such a manner that the injection hole 361 is located closer to the upper connecting portion 844 or the weft's flying position as compared with the profiled reed 32 (see FIG. 3) of the first embodiment. Therefore, the air stream velocity at the upper connecting portion 844 generally is higher than that at the upper connecting portion 344 in the first embodiment, thus causing the weft Y to fly faster than in the first embodiment.

Figure 24:
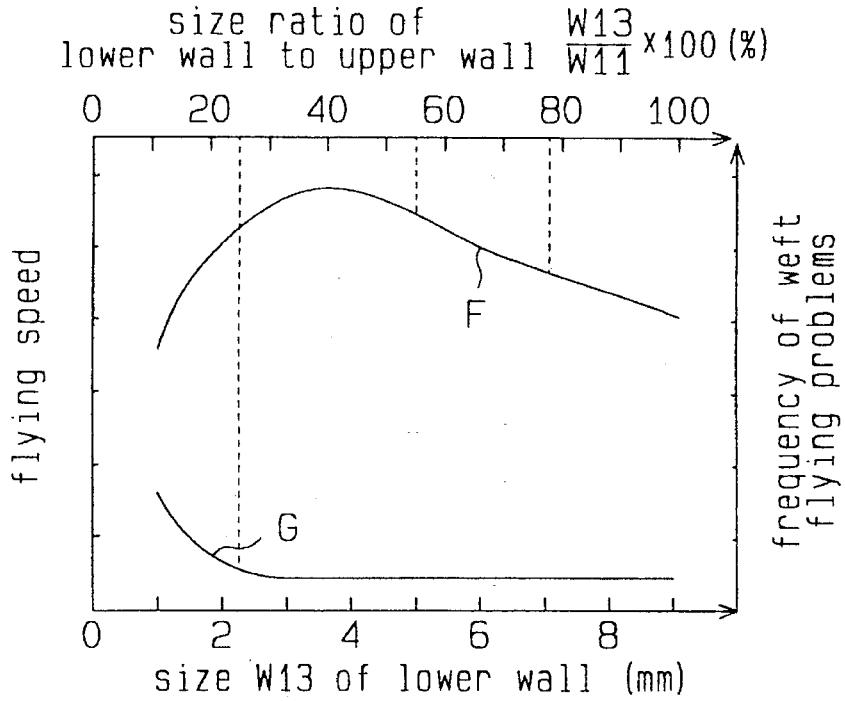
FIG. 24 is a graph for explaining the relation among the size of the lower wall, the flying velocity of weft and the frequency of weft flying problems.

With reference to FIG. 24, a description will now be given of the relation among the size W13 of the lower wall 843, the flying velocity of the weft Y and the frequency of weft flying problems, and the relation among the ratio, W13/W11×100, of the size of the lower wall 843 to the size of the upper wall 841, the flying velocity of the weft Y and the frequency of weft flying problems. A curve F represents data of the relation between the size W13 of the lower wall 843 and the flying velocity of the weft Y obtained through an experiment. A curve G represents data of the relation between the size W13 of the lower wall 843 and the frequency of flying problems of the weft Y obtained through an experiment. The frequency of flying problems of the weft Y is grasped as the weft Y not reaching a predetermined weft-insertion end within a predetermined period of time. The top horizontal scale indicates what the size W13 of the lower wall 843 indicated by the bottom horizontal scale is equivalent to a size ratio to the size of the upper wall 841. In those experiments, the distance L11 from the upper wall 841 to the injection hole 361 and the distance L12 from the distal end of the lower wall 843 to the injection hole 361 are set constant, and the air stream S injected from the supplemental nozzle 36 is always directed toward the upper connecting portion 844. Further, the flow amount of air injected from the supplemental nozzle 36 is set constant.

It is apparent from both curves F and G that as the size W13 of the lower wall 843 becomes smaller, the flying velocity of the weft Y can be increased while suppressing an increase in the frequency of the flying problems of the weft Y. In this embodiment where the size W13 of the lower wall 843 is set to 4 mm, the weft flying velocity is increased by 20% as compared with that in the first embodiment. If the extending size W13 is set too short, the function of the weft passage T defined by the upper wall 841, deep wall 842 and lower wall 843 to suppress the diffusion of the air stream becomes weaker, and a uniform air stream velocity distribution in the weft passage T cannot be obtained. Under this situation, the weft flying velocity drops and the frequency of the weft's flying off the weft passage T is increased. It is apparent from the top horizontal scale in FIG. 24 that this problem starts occurring when the ratio of the extending size W13 of the lower wall 843 to the extending size W11 of the upper wall 841 falls below 25%.

As disclosed in Japanese Unexamined Utility Model Publication No. Hei-3-38378, some conventional structures have the size of the lower wall extending from the deep wall set shorter than the size of the upper wall extending from the deep wall. There is, however, no specific disclosure on the relation between the size of the upper wall and the size of the lower wall as specifically discussed in the foregoing description of this embodiment. The experimental data in this embodiment has been obtained from studying the specific relation between the size of the upper wall and the size of the lower wall and the relation between the weft's flying velocity and the frequency of flying problems It is desirable from the experimental data shown in FIG. 24 that the ratio of the extending size W13 of the lower wall 843 to the extending size W11 of the upper wall 841 should fall within a range of 25% to 55%. The desirable size relation between the upper wall 841 and the lower wall 843 in this embodiment may be applied to the second to fifth embodiments.

In this sixth embodiment, the distance L12 from the distal end of the lower wall 843 to the injection hole 361 is set equal to the distance L2 in the first embodiment. The distance L12 may however be set larger when the ratio of the extending size W13 of the lower wall 843 to the extending size W11 of the upper wall 841 is set within a range of 25% to 55%. In this case, the bending of the warp between the reed pieces 83 and the supplemental nozzles 36 becomes smaller, thus preventing the weft from being damaged. Particularly, this modification is effective in weaving a fabric whose warp is likely to be damaged, such as a filament fabric.

As described earlier, the frequency of flying problems in the case where the conventional profiled reed 120, whose upper connecting portion has a radius of curvature r of about 2 mm is used, can be reduced to about one fifth or 20% by setting the radius of curvature r of the upper connecting portion 844 equal to or smaller than 1 mm.

Figures 25, 25A:
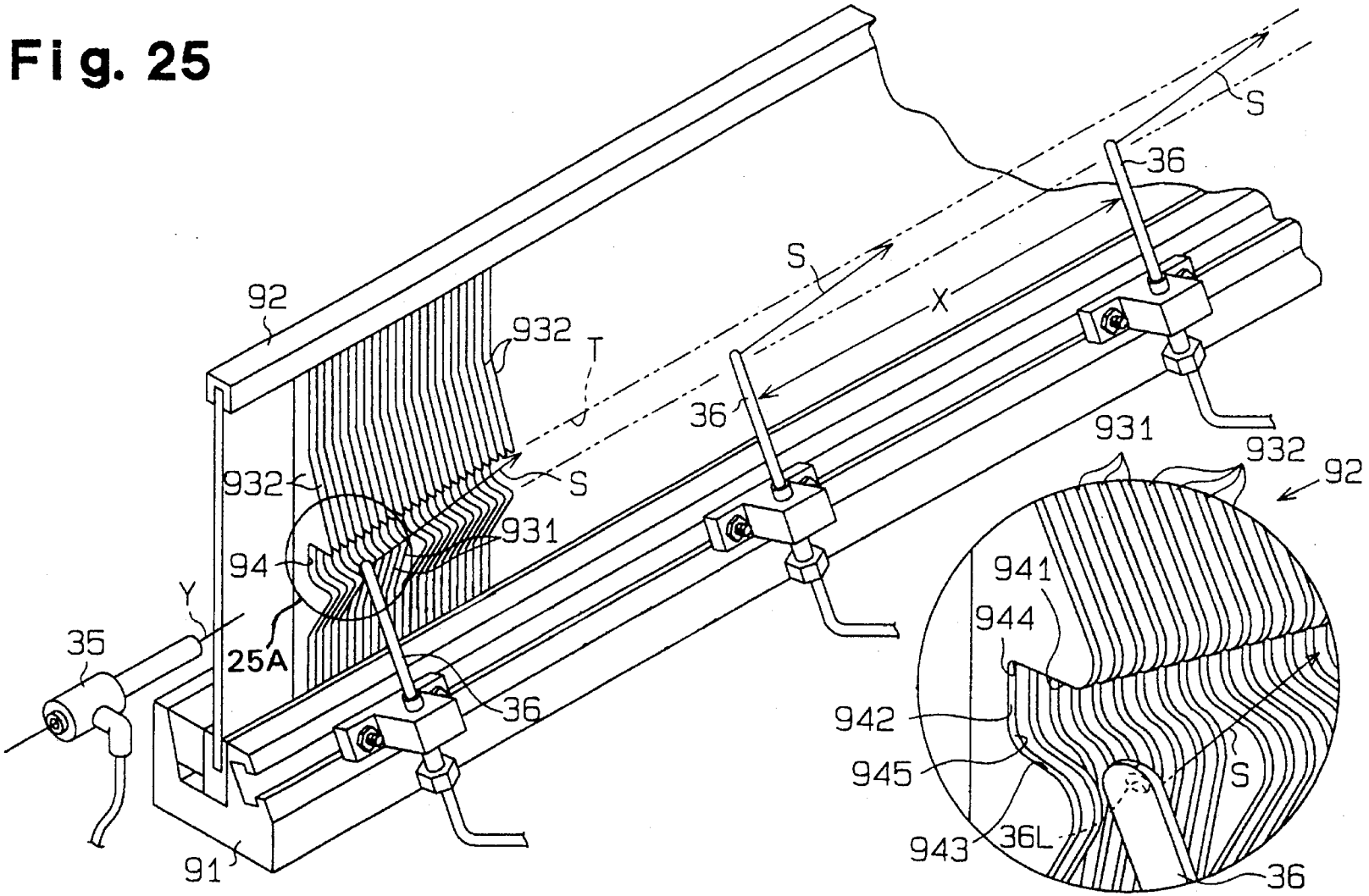
FIG. 25 is a view showing the general structure of a weft inserting device using a profiled reed according to a seventh embodiment including a region 25A
FIG. 25A is an enlarged view of region 25A of FIG. 25.

A seventh embodiment of this invention will now be described with reference to FIGS. 25, and 25A and 26. As shown in FIG. 25, a profiled reed 92 in this embodiment has two types of reed pieces 931 and 932 whose lower walls 942 have different sizes W33. The reed pieces 931 with a size W331 of 4 mm are arranged near the locations of the supplemental nozzles 36, and the reed pieces 932 with an extending size W332 of 7 mm are arranged at locations other than the locations of the supplemental nozzles 36.

Figure 26:
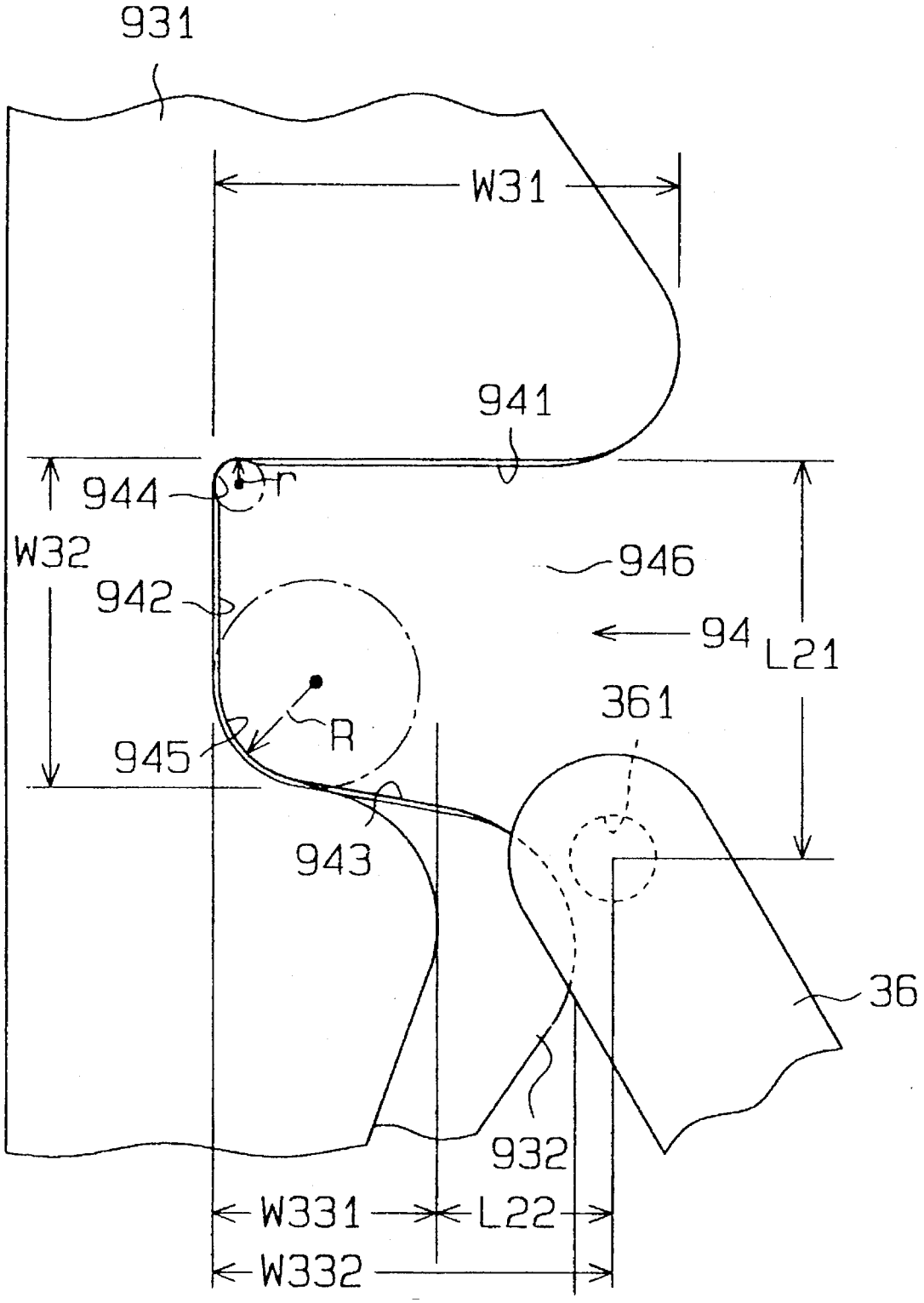
FIG. 26 is an enlarged side view of the essential portions of the weft inserting device according to the seventh embodiment.

As shown in FIG. 26, the size W31 of a upper wall 941 extending from a deep wall 942 of a guide notch 94 is set to 9 mm, and the vertical size W32 of the deep wall 942 is set to 5.5 mm. The reed pieces 931 with the size W331 of 4 mm are used between the position apart in the upstream of the weft passage T from the distal end of the supplemental nozzle 36 by 3 mm and the position apart in the downstream of the weft passage T from the distal end of the supplemental nozzle 36 by 15 mm. At the other portions, the reed pieces 932 with the size W332 of 7 mm are used. The distances L21 and L22 from the reed piece 931 to the injection hole 361 of the supplemental nozzle 36 and the other structures are set in the same way as done in the sixth embodiment. That is, the radius of curvature r of an upper connecting portion 944 is set to 0.5 mm, the radius of curvature R of a lower connecting portion 945 is set to 2 mm, and the distance from he deep wall 942 to the injection hole 361 is set shorter by 3 mm than the distance from the deep wall 342 to the injection hole 361 in the first embodiment. The injection hole 361 of the supplemental nozzle 36 is aligned in such a way as to direct the air stream S toward the upper connecting portion 944, as in the sixth embodiment.

As the radius of curvature r of the upper connecting portion 944 of the profiled reed 92 of this embodiment is set smaller than the radius of curvature R of the lower connecting portion 945, like the profiled reed 82 of the sixth embodiment, the weft Y flies stably in the vicinity of the upper connecting portion. The size W332 of the lower wall 943 of the reed piece 932 of the profiled reed 92 of this embodiment, at the portion excluding the neighborhood of the supplemental nozzle 36, is set longer by 3 mm than the size W22 of the lower wall 843 of the reed piece 83 in the sixth embodiment. Therefore, the air stream leaking downward of the opening 946 of the weft passage T is reduced, and the air stream velocity in the vicinity of the upper connecting portion 944 is generally increased. Consequently, the weft Y in this embodiment flies faster than the weft Y in the sixth embodiment.

Although only seven embodiments of the present invention have been described herein, it should be apparent to those skilled in the art that the present invention may be embodied in many other specific forms without departing from the spirit or scope of the invention. Particularly, it should be understood that this invention may be embodied in the following forms.

(1) The first to seventh embodiments may be properly combined.

(2) Although the angle between the upper wall and the deep wall in the above-described embodiments is set to the right angle, this angle may be set slightly narrower or wider.

(3) The boundary between the upper connecting portion and he upper wall or the boundary between the upper connecting portion and the deep wall may be shifted toward the upper wall or the deep wall, or may be shifted toward both walls.

Therefore, the present examples and embodiments are to be considered as illustrative and not restrictive and the invention is not to be limited to the details given herein, but may be profiled within the scope of the appended claims.

What is claimed is:

1. A weft inserting device of an air jet type loom comprising:

a sley;

a reed mounted on said sley, said reed including a plurality of adjacent reed pieces arranged along an inserting direction of a weft, each of said plurality of reed pieces having a recess into which the weft is inserted, a plurality of said recesses being aligned to form a weft passage;

a main nozzle for generating an air jet to insert the wet into the recesses; and a plurality of supplemental nozzles for generating respective air jets to assist the insertion of the weft into said recesses, said recesses being open towards said air jets generated by said supplemental nozzles;

said recess of each of said reed pieces being substantially defined by three walls, an upper wall, a lower wall and a deep wall, said lower wall being connected to said deep wall by a lower connecting portion having a first radius of curvature and said upper wall being connected to said deep wall by an upper connecting portion having a second radius of curvature, said deep wall being substantially flat and connecting said upper connecting portion to said lower connecting portion, said second radius of curvature being smaller than said first radius of curvature, to converge the air jet generated by said supplemental nozzles toward said upper connecting portion.

2. A weft inserting device of claim 1, wherein said second radius of curvature is no greater than 1 mm.

3. A weft inserting device of claim 2, wherein said lower wall has a length ratio with respect to the length of the upper wall ranging from 25% to 55%.

4. A weft inserting device of claim 1, wherein said lower wall has a length ratio with respect to the length of the upper wall ranging from 25% to 55% at least in the neighborhood of said supplemental nozzle.

5. A weft inserting device of claim 1 further comprising:

an air leakage means formed in each of said reed pieces for increasing the amount of air leaked from between said plurality of reed pieces at said upper connecting portion.

6. A weft inserting device of claim 5, wherein said second radius of curvature is no greater than 1 mm.

7. A weft inserting device of claim 5, wherein said air leakage means comprises an aperture formed in each of said reed pieces near said upper connecting portion.

8. A weft inserting device of claim 5, wherein said air leakage means comprises a groove formed near said upper connecting portion on each of a pair of opposite sides of adjacent reed pieces.

9. A weft inserting device of claim 8, wherein said groove extends from the upper connecting portion toward a side opposite to an open side of said recess.

10. A weft inserting device of claim 8, wherein said groove is located at a location above the upper wall.

11. A weft inserting device of claim 5, wherein said upper wall, said lower wall, said deep wall, said upper connecting portion and said lower connecting portion of each of said plurality of reed pieces have surfaces thereof inclined with respect to the inserting direction such that said recess of each of said reed pieces is narrowed in the inserting direction, and the degree of inclination of said upper connecting portion is less than the degree of the inclination of said upper wall, said lower wall, said deep wall, and said lower connecting portion.

12. A weft inserting device of claim 5, wherein the surface of said upper connecting portion of each recess is parallel to the inserting direction and said lower connecting portion is inclined with respect to the inserting direction such that said recess of each of said reed pieces is narrowed.

13. A weft inserting device of claim 5, wherein a surface of said upper connecting portion is inclined with respect to the inserting direction such that a surface of each of said reed pieces is widened in the inserting direction.

14. A weft inserting device of an air jet type loom comprising:

a sley;

a reed mounted on said sley, said reed including a plurality of reed pieces arranged along an inserting direction of the weft, each of said plurality of reed pieces having a recess into which a weft is inserted, a plurality of said recesses being aligned to form a weft passage;

a main nozzle for generating an air jet to insert the weft into the recesses;

a plurality of supplemental nozzles for generating respective air jet to assist the insertion of the weft into said recesses, said recesses being open towards said air jet generated by said supplemental nozzles;

said recess of each of said reed pieces being substantially defined by an upper wall, a lower wall and a deep wall, said lower wall being connected to said deep wall by a lower connecting portion having a first radius of curvature, which is greater than 1 mm, and said upper wall being connected to said deep wall by way of an upper connecting portion having a second radius of curvature no greater than 1 mm; and said lower wall having a length ratio with respect to the length of said upper wall ranging from 25% to 55% at least in the neighborhood of said series of supplemental nozzles.

15. A weft inserting device of an air jet type loom comprising:

a sley;

a reed mounted on said sley, said reed including a plurality of reed pieces arranged along an inserting direction of a weft, each of said plurality of reed pieces having a recess into which the weft is inserted, a plurality of said recesses being aligned to form a weft passage;

a main nozzle for generating an air jet to insert the weft into the recesses; and a plurality of supplemental nozzles for generating respective air jets to assist the insertion of the weft into said recesses, said recesses being open towards said air jets generated by said supplemental nozzles;

said recess of each of said reed pieces being substantially defined by an upper wall, a lower wall and a deep wall, said lower wall being connected to said deep wall by way of a lower connecting portion having a first radius of curvature and said upper wall being connected to said deep wall by way of an upper connecting portion having a second radius of curvature, said second radius of curvature being smaller than said first radius of curvature and no greater than about 1 mm.

* * * * *

UNITED STATES PATENT AND TRADEMARK OFFICE

CERTIFICATE OF CORRECTION

PATENT NO. : 5,588,470

DATED : December 31, 1996

INVENTOR(S) : M. Shiraki et al

It is certified that error appears in the above-indentified patent and that said Letters Patent is hereby corrected as shown below:

Column 1, line 63, after "1" insert comma --,--; line 66, before "shown" insert --as--; line 67, after "T" delete comma ",".

Column 2, line 27, after "31" insert comma --,--; line 31 change "portion" to --portions--.

Column 5, line 33 after "1A" change period "." to semi-colon --;--;

Column 6, line 41, after "embodiment" insert comma --,--.

Column 7, line 17, "notche" should read --notch--; line 22, after "1A-2" insert comma --,--.

Column 14, line 28, after "25" delete comma ",".

UNITED STATES PATENT AND TRADEMARK OFFICE

CERTIFICATE OF CORRECTION

PATENT NO. : 5,588,470

DATED : December 31, 1996 Page 2 of 2

INVENTOR(S) : M. Shiraki et al

It is certified that error appears in the above-indentified patent and that said Letters Patent is hereby corrected as shown below:

Column 15, line 40, "wet" should read --weft--;

Column 16, line 51, "jet" should read --jets--; line 52, "jet" should read --jets--.

Signed and Sealed this

Nineteenth Day of August, 1997

Bruce Lehman

*Attest:*

BRUCE LEHMAN

*Attesting Officer*

*Commissioner of Patents and Trademarks*